US007009353B2

(12) United States Patent
Dewert

(10) Patent No.: US 7,009,353 B2
(45) Date of Patent: Mar. 7, 2006

(54) FURNITURE DRIVE FOR ADJUSTING PARTS OF AN ITEM OF FURNITURE IN RELATION TO EACH OTHER

(75) Inventor: Eckhart Dewert, Zürich (CH)

(73) Assignee: Linak A/S, Nordborg (DK)

( * ) Notice: Subject to any disclaimer, the term of this patent is extended or adjusted under 35 U.S.C. 154(b) by 0 days.

(21) Appl. No.: 10/500,382

(22) PCT Filed: Dec. 20, 2002

(86) PCT No.: PCT/EP02/14617

§ 371 (c)(1),
(2), (4) Date: Sep. 29, 2004

(87) PCT Pub. No.: WO03/055359

PCT Pub. Date: Jul. 10, 2003

(65) Prior Publication Data

US 2005/0061096 A1 Mar. 24, 2005

(30) Foreign Application Priority Data

Jan. 4, 2002 (DE) ..... 102 00 169

(51) Int. Cl.
*B60N 2/04* (2006.01)
*F16M 13/00* (2006.01)

(52) U.S. Cl. ..... 318/467; 318/466; 248/429

(58) Field of Classification Search ..... 318/466, 318/467; 297/285, 470; 248/429, 394, 396
See application file for complete search history.

(56) References Cited

U.S. PATENT DOCUMENTS

| | | | | |
|---|---|---|---|---|
| 3,894,708 | A * | 7/1975 | Stanley | 248/294 |
| 4,326,690 | A * | 4/1982 | Pickles et al. | 248/396 |
| 4,696,512 | A * | 9/1987 | Burnett et al. | 297/68 |
| 5,751,129 | A * | 5/1998 | Vergin | 318/467 |
| 5,765,840 | A * | 6/1998 | Tame | 297/330 |
| 5,884,970 | A * | 3/1999 | Howard | 297/362.14 |
| 6,126,132 | A * | 10/2000 | Maue | 248/429 |
| 6,309,019 | B1 * | 10/2001 | Downey et al. | 297/344.1 |
| 6,352,312 | B1 * | 3/2002 | Rees | 297/470 |
| 2004/0169408 | A1 * | 9/2004 | Dewert | 297/285 |

* cited by examiner

*Primary Examiner*—Paul Ip
(74) *Attorney, Agent, or Firm*—Dykema Gossett PLLC

(57) ABSTRACT

An electric-motor driven furniture drive (2) for adjusting parts of an item of furniture in relation to each other, comprising two electric-motor driven adjustment units (4,6), both of which in an assembled position of the furniture drive (2) are actively connected to a part of the item of furniture to be adjusted in order to adjust same. According to the invention, a common drive motor (24) is provided in order to drive the adjustment units (4,6), in addition to coupling means which can move between a first and a second position. In the first position, said coupling means are used to couple the drive motor to the first adjustment unit (4) and in the second position, said coupling means are used to couple the drive motor to the second adjustment unit (6), thereby establishing a drive connection with the respective adjustment unit (4,6).

52 Claims, 20 Drawing Sheets

FURNITURE DRIVE FOR ADJUSTING PARTS OF AN ITEM OF FURNITURE IN RELATION TO EACH OTHER

BACKGROUND OF THE INVENTION

From EP 0 372 032 B1, DE 3842078 C2, EP 0583660 B1, DE 10017978 B1, DE 10017979 A1 and WO 01/76422 A1 furniture actuators of said type are known, which are also denoted double, dual or twin actuators. The known furniture actuators have two electromotively driven adjusting units, each of which is, in the assembled position of the furniture actuator, functionally connected to a portion of the piece of furniture to be adjusted for adjusting the same. For example, one of the adjusting units may serve to adjust the upper body supporting portion of a slatted grid, whereas the other one may serve for adjusting a leg supporting portion of the slatted grid. The adjusting units may e.g. be designed as spindle drives, whose spindle nut serves to swivel a pivot shaft which is functionally connected to the portion of the slatted grid to be adjusted, as is for example known from WO 01/76422 A1, particularly from FIG. 2 thereof. In order to be able to drive the adjusting units independently of each other each adjusting unit is associated with a separate drive motor with the drive motors being controllable mutually or independently of each other.

The known furniture actuators offer high comfort of adjustment. However, it is disadvantageous that the known furniture actuators are relatively complex regarding their structure and thus relatively expensive regarding their manufacture.

SUMMARY OF THE INVENTION

The invention is based on the object to provide a furniture actuator of the species as stated in the preamble of claim 1 for being produced in a more simple and thus less costly manner.

This object is achieved by the teaching stated in claim 1.

The invention breaks with the idea of associating one separate drive motor with each adjusting unit. Quite in contrast, it is rather based on the idea of providing a mutual drive motor for driving the adjusting units. In this way, the structure of the furniture actuator according to the invention is configured essentially more simply and thus more cost-efficiently.

In order to maintain, nevertheless, the adjusting comfort of the known furniture actuators, the invention provides coupling means which are moveable between a first position and a second position and couple the drive motor, in the first position, to the first adjusting unit and, in the second position, to the second adjusting unit, thus to bring them into driving connection with the respective adjusting unit. In this manner, the adjusting units can be driven independently of each other, so that the portions of the piece of furniture associated with the adjusting units, for example an upper body supporting portion and a leg supporting portion of a slatted grid can be adjusted independently of each other. In this manner, the same comfort of adjustment results as in the case of dual actuators according to prior art, in which a separate drive motor is associated with each adjusting unit.

The dual actuator according to the invention is appropriate for adjusting parts of any type of furniture, for example of parts of furniture for sitting and/or lying on. The furniture actuator according to the invention is particularly well-suited for adjusting portions of a slatted grid or the same.

The adjusting units may be designed in any suitable manner. Also, the transmitting of power of the mutual drive motor to the adjusting units may occur in any suitable manner. An embodiment of the teaching according to the invention provides for the adjusting units each having an actuating element to be driven to rotate, the drive motor, in a first position of the coupling means, being in rotary driving connection with the actuating element of the first adjusting unit and, in a second position of the coupling means, with the actuating element of the second adjusting unit. The adjusting units may in this embodiment be designed in the manner of a linear actuator, wherein the transmittal of power from the adjusting units to the respective portion of the piece of furniture associated with the corresponding adjusting unit may occur with an adjusting mechanism which can be selected in wide bounds according to the respective requirements.

A further development of the aforementioned embodiment provides that the actuating element be driven to rotate is part of a spindle drive which has a linearly moveable adjusting element being functionally connected, in the assembled position of the furniture actuator, with a portion of the piece of furniture to be adjusted. Such spindle drives are available as simple and cost-efficient standard components, so that the construction of the furniture actuator according to the invention is further simplified and thus designed more favourable regarding costs. Moreover, the spindle drives are robust and appropriate for applying large forces.

In the aforementioned embodiment the actuating element according to a further development can be a stationary spindle mounted to be driven to rotate, on which a spindle nut is arranged in a torque proof manner and moveable in the axial direction, which forms the adjusting element or is connected to the adjusting element.

In a kinematic reversal of the aforementioned embodiment, the actuating element may, however, also be a stationary spindle nut mounted to be rotated, which is arranged on a spindle moveable in the axial direction and being torque proof, which spindle forms the adjusting element or is connected to the adjusting element.

The power transmission of the adjusting element of the spindle drive to the associated portion of the piece of furniture to be adjusted may be performed in any suitable manner. A particularly simple embodiment which can thus be manufactured in an expedient manner regarding cost provides for the linearly moveable element to be in functional connection with a pivotably mounted shaft for pivoting the same in the assembled position of the furniture actuator, wherein the shaft is in functional connection with a portion of the piece of furniture to be adjusted. Such an adjusting mechanism is generally known and particularly suited for adjusting slatted grids. Regarding the construction of such an adjusting mechanism in detail, attention is drawn to WO 01/76422 A1, whose contents of disclosure are herewith included by reference in the present application. The shaft is normally not part of the furniture actuator, but rather a portion of the piece of furniture, for example a slatted grid.

In order to enable power transmission from the linearly moveable actuating element to the shaft in a particularly simple manner a further development of the aforementioned embodiment provides for a pivot lever being connected to the shaft in a torque proof manner, which lever is pivotable by means of the linearly moveable adjusting element.

The coupling means provided according to the invention may be designed in any appropriate manner, as long as it is assured that both adjusting units may be brought into a driving connection with the mutual drive motor. A corresponding design of the furniture actuator according to the invention makes it possible to bring the adjusting units into driving connection with the driving motor either simultaneously or successively.

An extremely advantageous embodiment of the basic idea of the teaching according to the invention provides for the coupling means to have a clutching arrangement which, in a first clutching-in position couples the actuating element of the first adjusting unit, and, in a second clutching-in position, couples the actuating element of the second adjusting unit to the drive motor, and thus brings the drive motor into a rotary drive connection with the respective actuating element. In this embodiment, the coupling means function in the manner of a clutch.

It principally suffices if the clutching arrangement has a first clutching-in position, in which the actuating element of the first adjusting unit is coupled to the drive motor, and a second clutching-in position, in which the actuating element of the second adjusting unit is coupled to the drive motor, wherein alternatively either the actuating element of the first adjusting unit or the actuating element of the second adjusting unit are coupled to the drive motor. In order to increase the comfort of adjusting further, a development of the aforementioned embodiment provides for the clutching arrangement to have a third clutching-in position in which the actuating element of the first adjusting unit as well as the actuating element of the second adjusting unit are coupled to the drive motor. In this embodiment, the adjusting units can be adjusted according to the respectively selected clutching-in position either separate from each other or together, so that the same comfort of adjusting is attained without restrictions as occurs in the case of furniture actuators according to prior art, in which each adjusting unit is associated with a separate drive motor.

Principally, the furniture actuator may be structured such that in each clutching-in position at least one adjusting unit is in driving connection with the drive motor. A particularly advantageous development of the embodiment including the clutching arrangement moreover provides the clutching arrangement to have a fourth clutching position in which the actuating element of the first adjusting unit as well as the actuating element of the second adjusting unit are de-coupled from the drive motor. In this embodiment, both adjusting units are de-coupled from the drive motor in the fourth clutching position, so that it is e.g. possible with a corresponding design of the adjusting units to manually re-set the portions of the piece of furniture adjusted by means of the adjusting units in the fourth clutching position, with the drive motor turned off.

Expediently, the clutching arrangement has at least one clutch coupling or shifting coupling clutch. With a corresponding design of the shifting coupling clutch a single coupling clutch will suffice in order to clutch-in the first adjusting unit and the second adjusting unit to the drive motor. However, it is also possible to associate each adjusting unit with a separate coupling clutch.

The coupling clutch may be chosen according to the respective requirements. For example, the coupling clutch can be a clutch with frictional engagement. An advantageous development provides that the coupling clutch is a clutch with positive engagement. Such couplings can be manufactured simply and thus cost-efficiently and are appropriate for transmitting high torques.

A development of the aforementioned embodiment provides for the coupling clutch to have a clutching element on the pinion end side which is in rotary driving connection with the drive motor, and that the rotatingly driveable actuating elements of the adjusting units are each associated with a power take-off side clutching element, wherein the power take-off side clutching elements can be brought into engagement with the pinion end clutching element in order to clutch-in the respective adjusting unit to the drive motor. In this embodiment, the coupling is structured particularly simple and thus designed cost-efficiently.

The power transmission from the respective power take-off side clutching element to the actuating element of the respective adjusting units may be performed in any suitable manner. According to one embodiment, the power take-off side clutching element associated with an adjusting unit is connected with the actuating element of this adjusting unit in a torque proof manner. If the adjusting units are, for example, designed as spindle drives, the respective power take-off side clutching element can be mounted on the spindle of the spindle drive in a torque proof manner.

According to another embodiment, the power take-off side clutching element associated with an adjusting unit may, however, also be in a rotary drive connection with the actuating element of this adjusting unit via a gear arrangement. In this embodiment, the gear arrangement makes it possible, for example, to attain an additional stepping-down.

In the aforementioned embodiment, the power take-off side clutching element is expediently designed as a toothed wheel or is connected to a toothed wheel in a torque proof manner, which toothed wheel is in engagement with a toothed wheel connected to the actuating element in a torque proof manner. In this embodiment, the gear arrangement is a toothed gearing which can be manufactured simply and thus cost-efficiently. If the axles of rotation of the power take-off side clutching element and of the actuating element of the respective adjusting unit run parallel to each other, it is expedient to have the toothed gears designed as spur(-toothed) wheels.

The pinion side clutching element can be designed in any appropriate manner. A development provides for the pinion side clutching element to be designed as a worm wheel or be connected to a worm wheel in a torque proof manner, which worm wheel is in engagement with a worm connected to the power take-off shaft of the drive motor. In this embodiment, the power transmittal from the driving or output shaft of the drive motor is performed onto the pinion side clutching element in the manner of a worm drive, which is suited for transmitting high forces and can be manufactured simply and thus cost-efficiently.

An extraordinarily advantageous development of the embodiment having the coupling clutch provides for the pinion side clutching element and/or at least one of the power take-off side clutching elements to be mounted in an axially moveable manner such that by axial movement of the pinion side clutching element and/or at least one of the power take-off side clutching elements the power take-off side clutching elements can be brought out of respectively into engagement with the pinion side clutching element or may be disengaged from the same. In this embodiment, the shifting of the coupling clutch is performed by axial displacement of one of the clutching elements. Such a clutching arrangement is particularly simple and can thus be manufactured cost-efficiently and is robust regarding its construction.

An expedient configuration of the aforementioned embodiment provides for the power take-off side clutching elements to be arranged in a stationary manner and for the pinion side clutching element to be arranged, in the axial direction, between the power take-off side clutching elements and to be axially moveable. In this embodiment the shifting of the coupling clutch occurs by axial movement of the pinion side clutching element which can be moved to and fro in the axial direction between the power take-off side clutching elements.

In a kinematic reversal of the aforementioned embodiment, the pinion side clutching element, however, may well be arranged in a stationary manner, wherein at least one of the power take-off side clutching elements is axially moveable. In this embodiment, the shifting of the coupling clutch occurs through axial movement of at least one of the power take-off side clutching elements.

A development of the aforementioned embodiment provides for the power take-off side clutching elements to be axially moveable separate from each other. In this embodiment, the power take-off side clutching elements and thus the associated adjusting elements can be coupled to the drive motor or de-coupled from the same separately from each other.

In order to simplify the structure of the clutching arrangement even further, and thus to design it more cost-efficiently, it is expedient that the power take-off side clutching elements be axially moveable together. In this embodiment, the power take-off side clutching elements and thus the adjusting units associated with them are coupled to or off the drive motor simultaneously, for example such that when clutching-in one adjusting unit the other adjusting unit will be de-coupled.

In order to move the power take-off side clutching elements axially together, an expedient embodiment provides for the power take-off side clutching elements to be mounted at a fixed distance to each other on an axially moveable shaft, wherein the axial distance of the clutching elements with regard to each other is selected such that in a first position of the shaft the power take-off side clutching element of the first adjusting unit is in engagement with the pinion side clutching element and the power take-off side clutching element of the second adjusting unit is out of engagement of the pinion side clutching element, whereas in a second position of the shaft the power take-off side clutching element of the second adjusting unit is in engagement with the pinion side clutching element and the power take-off side clutching element of the first adjusting unit is out of engagement of the pinion side clutching element. This embodiment enables simultaneously a clutching-in of one adjusting unit to the drive motor and a de-coupling of the other adjusting unit from the drive motor by shifting the shaft. The shaft may, for example, be mounted in a housing of the furniture actuator by means of ball-bearings.

In principle, it suffices if one power take-off side clutching element is associated with each adjusting unit. An extremely advantageous development of the teaching according to the invention provides for one further clutching element, each being associated with at least one adjusting unit, but preferably one further clutching element each associated with both adjusting units, which further clutching element is arranged, when seen in the axial direction, on the side opposite the pinion side clutching element of the power take-off side clutching element of this adjusting unit and is in rotary drive connection with the actuating element of this adjusting unit such that by axial movement of the clutching element the further clutching element, and thus the actuating element, can be clutched-in with the pinion side clutching element or be de-coupled there from. This embodiment enables, in particular, a clutching-in or de-coupling of the adjusting units with respect to the drive motor separately from each other. For bringing about a rotary drive connection between the further clutching element of one adjusting unit and the actuating element of this adjusting unit, the further clutching element may, for example, be connected to the actuating element in a torque proof manner. The further clutching element may, however, for example, also be in a rotary drive connection with the actuating element via a gearing arrangement, in particular a toothed wheel gearing.

In order to be able to make the further clutching element engage the power take-off side clutching element, or disengage from the same in the case of the aforementioned embodiment, it is expedient that the power take-off side clutching elements of the adjusting units have axial protrusions at both their axial sides, each, via which protrusions they engage complementarily-shaped recesses in the respective clutching position, which recesses are formed on the pinion side clutching element's and the further clutching element's side facing the respective power take-off side clutching element. By a corresponding selection of the axial length of the protrusions it may be selected at which axial shifting of the power take-off side clutching element of the respective adjusting unit the further clutching element can be clutched-in with or de-coupled from the pinion side clutching element, and thus the drive motor.

Expediently, the pinion side clutching element and the power take-off side clutching elements and, if necessary, the further clutching elements are mounted in a co-axial manner.

In the embodiment in which the pinion side clutching element is moveable axially, the drive motor may be arranged stationarily. In this manner, the construction is designed simply and thus cost-efficiently. For example, the pinion side clutching element can be formed by a worm wheel or connected to a worm wheel in a torque proof manner, which worm wheel engages a worm which is connected to the power take-off shaft of the drive motor, in particular moulded onto the take-off shaft. As the drive motor is arranged stationarily, the axial length of the worm wheel, in the case of this example of embodiment, is selected such that the worm wheel will be engaging the worm in all positions occurring in the case of an axial displacement of the worm wheel.

A further development of the embodiment with the axially moveable pinion side clutching element provides for the pinion side clutching element to be arranged on moveable support means together with the drive motor such that the pinion side clutching element can be moved together with the drive motor. In this embodiment, the position of the pinion side clutching element does not change relative to the power take-off shaft of the electromotor when axial adjustment occurs. If the pinion side clutching element and the power take-off shaft of the electromotor engage via a toothing, for example via a worm gear, difficulties can be avoided in this embodiment which could occur by a displacement of the toothings relative to each other. In particular, damages to the toothing occurring in the case of axial displacement of the clutching element can be avoided.

The support may be moved in any suitable manner. Expediently, the support means can be displaced in the axial direction of the pinion side clutching element.

Basically, the moveable clutching element can be moved to and fro by any suitable activating means between the differing clutching positions. In order to simplify the structure and thus to make it more cost-efficient, it is expedient that spring means for biasing the moveable clutching element or at least one of the moveable clutching elements into a start position are provided. In this embodiment, the spring means always re-set the moveable clutching element after an axial displacement into its starting position. The spring means can be designed in any suitable manner, for example according to the respective requirements as compression or tension spring means. Principally, it suffices if the spring means have a single spring. If necessary, however, several springs may be provided.

For moving the moveably mounted clutching element, activating means are expediently provided.

A further expedient development provides for the drive motor to being capable of being brought into a rotary drive connection with the actuating elements of the adjusting units via a gearing arrangement. In this embodiment, a desired gearing down can be achieved by the respective selection of the gearing arrangement.

In context with the aforementioned embodiment, a further configuration of the basic idea of the teaching of the invention provides for the coupling means having a moveable support means in which at least one gear element of the gearing arrangement is mounted, wherein the support means is moveable between a first position, in which the gearing arrangement brings about the rotary drive connection of the actuating element of the first adjusting unit with the drive motor, and a second position, in which the gearing arrangement brings about the rotary drive connection of the actuating element of the second adjusting unit with the drive motor. In this embodiment, no clutching arrangement is necessary. On the contrary, the coupling of the adjusting units is performed via a corresponding movement, for example by displacement of the support means.

According to the respective requirements, the support means may be linearly displaceable and/or rotatable and/or tiltable, as is provided by further embodiments.

A particularly simple and thus cost-efficiently produceable development of the embodiment including the moveable support means provides that the gearing arrangement has a first and a second toothed wheel which are mounted on a mutual shaft driven to rotate by the drive motor in a torque proof manner, and that a third gear wheel and a fourth gear wheel are associated with the actuating element of the first adjusting unit and the actuating element of the second adjusting unit, respectively, wherein the support means can be moved relative to the third and fourth gear wheels such that in the first position of the support means the first gear wheel engages the third gear wheel, whereas the second gear wheel is out of engagement of the fourth gear wheel, and that in the second position of the support means the second gear wheel engages the fourth gear wheel, while the first gear wheel is out of engagement of the third gear wheel.

If the support means is mounted in a manner allowing it to rotate, it is expedient that the first and the second gear wheels are bevel wheels, whereby the mounting can be rotated preferably in the radius about the take-off shaft of the drive motor.

In principle, the drive motor can be arranged in a stationary manner in the case of the embodiment showing the moveable support means as long as it is safeguarded by a corresponding gearing arrangement that the drive motor, in the first and second positions of the support means, engages the gearing arrangement placed on the support means. In order to simplify the structure it is, however, expedient that the drive motor is arranged on the support means in a manner that the gearing arrangement can be moved together with the drive motor. In this embodiment, the drive motor is always drive-connected with the gearing arrangement, so that the gearing arrangement may have a simple structure.

A further expedient development of the embodiment showing the moveable support means provides spring means for biasing the support means into a starting position. In this embodiment, the moveable support means always returns into its starting position after movement.

Expediently, actuating means are provided for moving the support means.

In the embodiments showing at least one moveable clutching element, and the embodiments showing the moveable support means, the actuating means for moving the clutching element and the support means, respectively, may be mechanical actuating means. In this manner, no electric power is required for moving the clutching element or the support means, so that the clutching element and the support means, respectively, may also be moved in an idle or currentless state of the furniture actuator. A further advantage of this embodiment is that the power consumption is small.

In the aforementioned embodiment, the mechanical actuating means expediently have pulling means which can be operated manually. The manually operatable pulling means may, for example, be formed by a (round) cord, a rope, or a Bowden pull wire, or the like, so that by manually pulling on the pulling means the moveable component may be moved.

In order to reduce the power necessary for moving the moveable component, another embodiment provides for the actuating means being electromechanical actuating means. In this manner, the comfort of operation will be increased. The electromechanical actuating means may at least have one electromagnet and/or at least one servo motor as provided for by further developments. By means of the electromotor the moveable component, i.e. a moveable clutching element or a moveable support means can be moved between their respective positions. If the electromechanical actuating means have, for example, one electromagnet, the moving of a moveable clutching element from a first clutching position into a second clutching position can, for example, occur by means of the electromagnet, whereas the re-setting from the second clutching position into the first clutching position may, for example, be performed by the effect of spring means. In this manner, the structure of the furniture actuator according to the invention is further simplified. However, it is also possible to use, for example, two electromagnets which function opposedly.

For moving the moveable component, i.e. a moveable clutching element or a moveable support means, it is expedient to provide at least one two-armed lever whose one lever arm is functionally connected to the moveable component and whose other lever arm is functionally connected to the actuating means. Such an arrangement is simple and can thus be manufactured cost-efficiently.

For switching the drive motor on and off, switching means are preferably provided.

According to the respective requirements, in the case of the embodiments with the spindle drive, the latter may be self-locking or non-self-locking, as is provided by embodiments. If the spindle drive is self-locking, a portion of the piece of furniture which has been adjusted by means of the furniture actuator according to the invention will remain in its respective adjusted position after adjustment. If, in contrast thereto, the spindle drive is non-locking, an adjusted portion of the piece of furniture can be returned manually from the respective adjustment position to a starting position upon switching off the actuator.

In order to enable, when the actuator is switched on, an adjustment of a portion of the piece of furniture from a starting position into an adjustment position as well as a re-setting from the adjustment position into the starting position, it is expedient that controlling means are provided for controlling the direction of rotation of the drive motor.

Hereafter, the invention will be explained in greater detail referring to the accompanying drawing in which examples of embodiment of a furniture actuator according to the invention is represented.

BRIEF DESCRIPTION OF THE DRAWINGS

It is shown in.

DETAILED DESCRIPTION OF THE INVENTION

Figure 1:
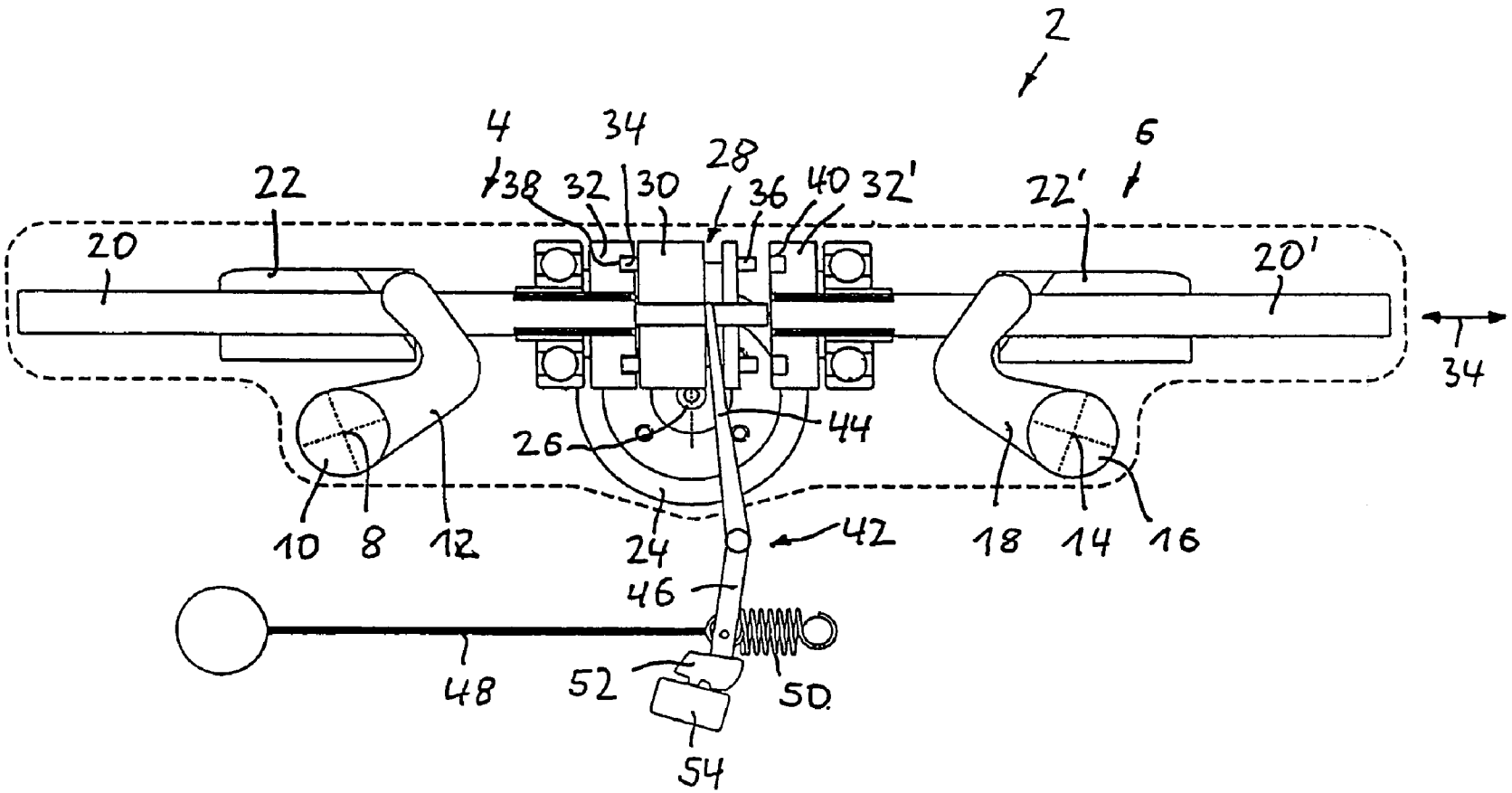
FIG. 1 by way of a schematic, partially sectioned side view of a first example of embodiment of a furniture actuator according to the invention in a first clutching position, FIG. 2 by way of similar representation as in FIG. 1 the furniture actuator according to FIG. 1 in a second clutching position, FIG. 3 a schematic, partially sectioned top view of a second example of embodiment of a furniture actuator according to the invention in a first clutching position, FIG. 4 by way of similar representation as in FIG. 3 the furniture actuator according to FIG. 3 in a second clutching position, FIG. 5 by way of similar representation as in FIG. 1 a third example of embodiment of a furniture actuator according to the invention in a first clutching position, FIG. 6 by way of similar representation as in FIG. 5 the furniture actuator according to FIG. 5 in a second clutching position, FIG. 7 by way of similar representation as in FIG. 5 the furniture actuator according to FIG. 5 in a third clutching position, FIG. 8 by way of similar representation as in FIG. 1 a fourth example of embodiment of a furniture actuator according to the invention in a first clutching position, FIG. 9 by way of similar representation as in FIG. 8 the furniture actuator according to FIG. 8 in a second clutching position, FIG. 10 by way of similar representation as in FIG. 1 a fifth example of embodiment of a furniture actuator according to the invention in a first clutching position, FIG. 11 by way of similar representation as in FIG. 10 the furniture actuator according to FIG. 10 in a second clutching position, FIG. 12 by way of similar representation as in FIG. 1 a sixth example of embodiment of a furniture actuator according to the invention in a first clutching position, FIG. 13 by way of similar representation as in FIG. 12 the furniture actuator according to FIG. 12 in a second clutching position, FIG. 14 by way of similar representation as in FIG. 12 the furniture actuator according to FIG. 12 in a third clutching position, FIG. 15 by way of similar representation as in FIG. 12 the furniture actuator according to FIG. 12 in a fourth clutching position, FIG. 16 by way of similar representation as in FIG. 1 a seventh example of embodiment of a furniture actuator according to the invention in a first position of a moveable support means, FIG. 17 by way of similar representation as in FIG. 16 the furniture actuator according to FIG. 16 in a second position of the moveable support means, FIG. 18 by way of similar representation as in FIG. 16 a modification of the furniture actuator according to FIG. 16, FIG. 19 by way of similar representation as in FIG. 1 an eighth example of embodiment of a furniture actuator according to the invention in a first position of a moveable support means, and FIG. 20 by way of similar representation as in FIG. 19 the furniture actuator according to FIG. 19 in a second position of the moveable support means.

In the figures of the drawing same or corresponding components have been provided with the same reference numerals.

In FIG. 1 an electromotive furniture actuator 2 for adjusting portions of a piece of furniture relatively to each other is represented, which actuator, in the present exemplified embodiment, serves for adjusting support portions of a slatted grid not shown in the drawing. The furniture actuator 2 has two electromotively actuated adjusting units 4, 6, of which only the first adjusting unit 4 will be explained more closely in the following. The second adjusting unit 6 is structured correspondingly and its components are provided with the reference numerals corresponding to the components of adjusting unit 4. In the assembled position of the furniture actuator 2 the adjusting unit 4 is functionally connected to an upper body support portion of a slatted grid for adjusting the same, whereas the adjusting unit 6 is functionally connected to a leg supporting portion of the slatted grid for adjusting the same. Associated with the leg support portion of the slatted grid there is a shaft 10 which can be swivelled about an axis 8, to which a pivot lever 12 is connected in a torque proof manner. In a corresponding manner, the leg support portion of the slatted grid is associated with a shaft 16 to be swivelled about an axis 14, with which shaft a pivot lever 18 is torque-proofly connected. The manner in which the upper body support portion and the leg support portion may be pivoted by means of the shafts 10, 16 is known to the expert and need not be explained herein. For example, attention is drawn to WO 01/76422A1.

The adjusting unit 4 is formed as a spindle drive in the present exemplified embodiment and has an actuating element to be driven to rotate, in the form of a stationary spindle 20 mounted to rotate, on which a spindle nut 22 is arranged torque proofly and moveable in the axial direction, which nut forms an adjusting element of adjusting unit 4 and loosely charges pivot lever 12 for pivoting the same. When the spindle 20 is driven to rotate, the spindle nut 22 moves, under the effect of the spindle thread, either to the right or the left in the drawing, according to the direction of rotation of spindle 20.

For actuating the adjusting units 4, 6, according to the invention there is a provided a mutual drive motor 24 in the form of an electromotor whose power take-off shaft is designed as a worm 26. Furthermore, according to the invention, there are provided coupling means which can be moved between a first position and a second position, and which, in the first position, couple the drive motor 24 to the first adjusting unit 4, and in the second position, to the second adjusting unit 6, thus bringing about driving or actuating connections to the respective adjusting unit 4 and 6, respectively. In the present example of embodiment, the coupling means have a clutch arrangement in the form of a shifting coupling clutch 28, which in a first clutching position represented in FIG. 1 couples the spindle 20 of the adjusting unit 4 to the drive motor 24, and thus brings the drive motor 24 into rotary drive connection with the spindle 20.

The shifting coupling clutch 28 is formed as a positive locking shifting clutch in the present exemplified embodiment, and has a pinion side clutching element 30, which in the present example of embodiment is formed by a worm wheel 30 engaging the worm 26 of the drive motor 24. The adjusting spindles 20, 20' of the adjusting units 4, 6, respectively, are each associated with a power take-off side clutching element 32 and 32', respectively, wherein the power take-off side clutching elements 32, 32' can be brought into engagement with the pinion side clutching element 30 for coupling the respective adjusting unit 4, 6 to the drive motor 24. The power take-off side clutching element 32 is connected torque proofly with the spindle 20, whereas the power take-off side clutching element 32' is connected torque proofly to the spindle 20'.

In the exemplified embodiment represented in FIG. 1, the pinion side clutching element 30 is mounted to be moveable in the axial direction of spindles 20, 20', i.e. in the direction of the double arrow 31 of FIG. 1, such that by axial movement of the pinion side clutching element 30 alternately an engagement of the power take-off side clutching element 32 of the adjusting unit 4 or the power take-off side clutching element 32' of adjusting unit 6, respectively, can be brought about with the pinion side clutching element 30. In order to clutch the pinion side clutching element 30 torque proofly to the respective power take-off side clutching element 32 and 32', respectively, in the respective coupling or clutching position, the pinion side clutching element 30 has, on its axial sides facing the power take-off side clutching elements, axial protrusions 34, 36, which engage recesses 38, 40 on the power take-off side clutching elements 32, 32', respectively, which recesses are formed complementary regarding the protrusions 34, 36. As it cannot be taken from the drawing and is thus explained herein, the axial protrusions arranged on one axial side of the pinion side clutching element 30 extend, in the peripheral direction of the clutching element 30, only over a short distance and are arranged at a peripheral distance from each other such that in this manner in the clutching position a positive engagement can be brought about between the pinion side clutching element 30 and the power take-off side clutching element 32 and 32', respectively.

Figure 2:
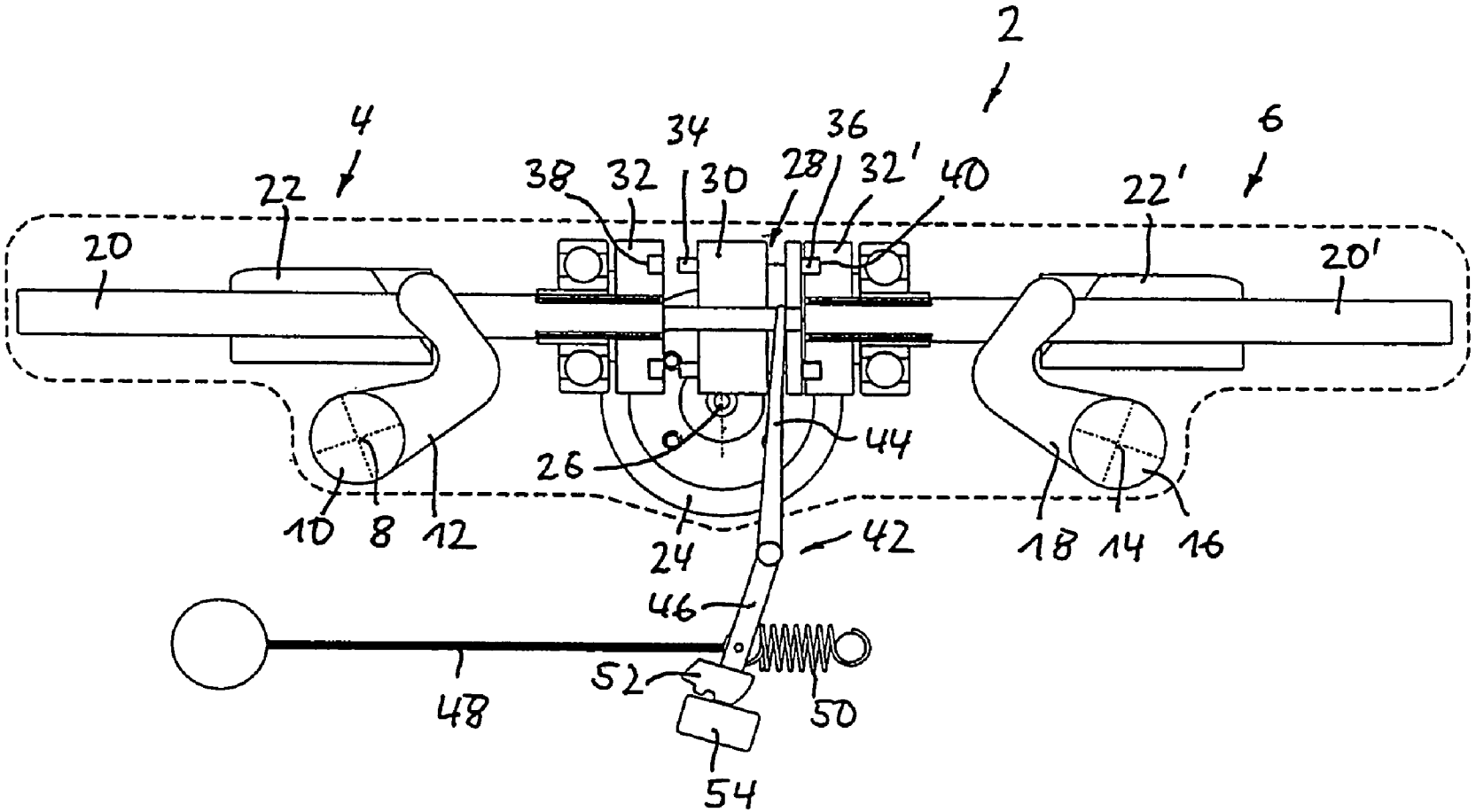

In order to move the pinion side clutching element 30 to and fro axially between the first coupling position shown in FIG. 1 and a second coupling position shown in FIG. 2, there is provided a two-armed lever 42 whose one lever arm 44 engages the pinion side clutching element 30 and whose other lever arm 46 is connected with a mechanical activating means in the form of a pull-string 48 which can be handled manually. It cannot be taken from the drawing and is therefore explained herein that the lever arm 44 is shaped as a fork and engages a circumferential groove on the outer surface of the pinion side clutching element 30.

In order to bias the pinion side clutching element 30 into the first coupling position represented in FIG. 1, there are provided spring means in the shape of a tension spring 50 which is designed as a helical spring.

On the free end of lever arm 46 there is provided a shifting gate 52 which serves for activating a switch 54 which is in control connection with the drive motor 24.

The operation of the furniture actuator 2 is as follows:

In the first clutching or coupling position represented in FIG. 1, the pinion side or pinion end clutching element 30 is biased towards the left in FIG. 1 via the two-armed lever 42 and the tension spring 50, so that it engages the power take-off side clutching element of the adjusting unit 4. At this time, the protrusions 34 of the pinion end clutching element 30 engage the recesses 38 of the power take-off side clutching element 32 of adjusting unit 4, so that the pinion end clutching element 30 is torque proofly connected with the power take-off side clutching element 32 and thus with the spindle 20.

For turning on the furniture actuator 2 the user pulls the pull-string 48 towards the left in FIG. 1 by a short distance, whereby the shifting gate 52 activates the switch 54, so that the drive motor 24 is turned on and rotatingly drives the spindle 20 of the adjusting unit 4 via the worm 26 and the pinion end clutching element 30 formed as a worm wheel and the power take-off side clutching element 32 torque proofly connected with the same, so that the spindle nut 22 is, when seen in the drawing, threadably moved towards the right according to the direction of rotation of the worm 26 of drive motor 24. At this time, the spindle nut 22 pivots the pivot lever 12, so that the shaft 10 is pivoted about axis 8 and the upper body support portion of the slatted grid, which is in connection with shaft 10 is adjusted. When the desired adjustment position has been reached, the user lets go of the pull-string 48, so that the shifting gate 52 turns off the drive motor 24.

In cannot be taken from the drawing and is thus explained herein that controlling the drive motor 24 by means of switch 54 occurs through a flip-flop switch which is designed such that in the case of a one-time pull of the pull-string 48 the drive motor 24 may run in a first direction of rotation whereas the drive motor 24 in the case of a renewed pulling of the pull-string 48 will run in a second direction of rotation contrary to the first one.

The axial width of the annular groove on the outer surface of the pinion end clutching element 30 is dimensioned such that on switching on the drive motor 24 and the short angular movement of the two-armed lever 42 in context therewith, the pinion end clutching element 30 is not displaced in axial direction.

In order to clutch-in the drive motor 24 to the second adjusting unit 6, the user pulls the pull-string anew, whereby the drive motor 24 is first switched on briefly and subsequently turned off again via the shifting gate 52. In the case of further pulling of the pull-string 48 towards the left-hand side in FIG. 1, the pivoting lever 42 in FIG. 1 swivels clockwise, so that its free end 44 entrains the pinion end clutching element 30 and moves the same in the axial direction towards the right in FIG. 1 until the second clutching position represented in FIG. 2 has been reached. In the second clutching position the pinion end clutching element 30 engages the recesses 40 of the power take-off side clutching element 32' with the protrusions 36 so that the pinion end clutching element 30 is clutched-in, in a torque proof manner, with the power take-off side clutching element 32' and thus with the spindle 20'. As can be taken from FIG. 2, the pinion side clutching element 30 is in this case out of engagement regarding the power take-off side clutching element 32 of adjusting unit 4, so that the spindle thereof is de-coupled from the drive motor 24.

Subsequently thereto, the user releases the pull-string 48 by a short distance towards the right in FIG. 2, so that the shifting gate 52 turns on the drive motor 24, so that this now drives the adjusting spindle 20' to rotate and the spindle nut 22' threadingly moves towards the left in FIG. 2 and hereby swivels the pivot lever 18 in counterclockwise direction in FIG. 2. Hereby, the shaft 16 is swivelled about the axis 14, so that the leg supporting portion of the non-shown slatted grid is adjusted. If a desired position of adjustment of the leg support portion has been reached, the user lets go of the pull-string 48, so that the tension spring 50 will swivel the two-armed lever 42 counterclockwise in FIG. 2, and this lever will move the pinion end clutching element 30 from the second clutching position represented in FIG. 2 back into the first clutching position represented in FIG. 1. In this first clutching position the adjusting spindle 20 of the adjusting unit 4 is again clutched-in or coupled with the pinion end clutching element 30, whereas the adjusting spindle 20' of the adjusting unit 6 is de-coupled from the pinion end clutching element 30.

Thus, in the furniture actuator 2 according to the invention only one single drive motor 24 is necessary for driving the adjusting units 4, 6, so that the furniture actuator 2 according to the invention can be manufactured in a particularly simple and thus cost-efficient manner. Due to the coupling means being formed by the coupling clutch 28 in the exemplified embodiment according to FIG. 1, the adjusting units 4, 6 can, nevertheless, be driven separately from each other, so that the adjustable portions of the slatted grid being associated with them can be adjusted separately from each other. Thus, when comparing with furniture actuators in which a separate drive motor is associated with each adjusting unit, the essentially same adjusting comfort may be attained.

A re-adjustment of the slatted grid portions adjusted by means of the furniture actuator 2 can either be performed with the drive turned on by reversing the direction of rotation of the drive motor 24. A return adjustment can, however, also be performed by moving the pinion end clutching element into an axial position between the power take-off side clutching elements 32, 32', in which position the pinion end clutching element 30 is not in engagement with both take-off side clutching elements 32, 32'. If the spindle drives 20, 22; 20', 22', respectively, are formed to be non-self-locking, the supporting portions of the slatted grid may then be return-adjusted manually with the drive turned off, whereby the spindle nuts 22, 22' on the spindles 20, 20' screw back into their starting position.

Figure 3:
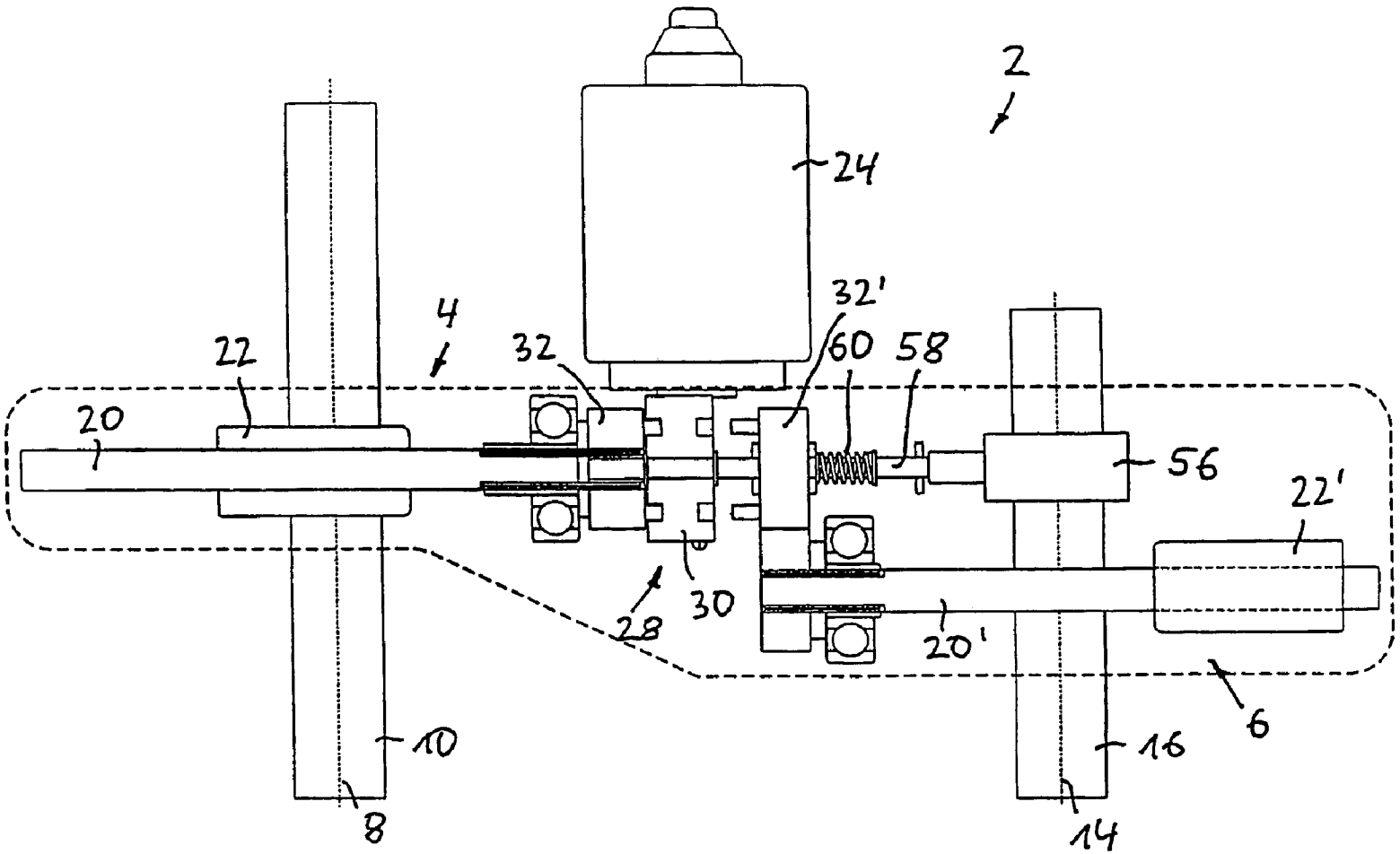

A second exemplified embodiment of a furniture actuator 2 according to the invention is represented in FIG. 3 differing from the exemplified embodiment according to FIG. 1, particularly in that the activating means for axial displacement of the pinion end clutching element 30 are formed as electromechanic activating means. The electromechanic activating means have an electromagnet 56, by means of which an axle 58 can be shifted towards the left in FIG. 3 counter the effect of a pressure spring 60 provided as a helical spring. The electromagnet 56 can, for example, be operated via a manual operating device, for example a hand switch, by the user of the furniture actuator 2.

In the first clutching position represented in FIG. 3, the pinion end clutching element 30 has been shifted towards the left in FIG. 3 by means of the electromagnet 56, and is in engagement with the take-off side clutching element 32 of the adjusting unit 4, whereas the take-off side clutching element 32' of the adjusting unit 6 is out of engagement with the pinion end clutching element 30.

Figure 4:
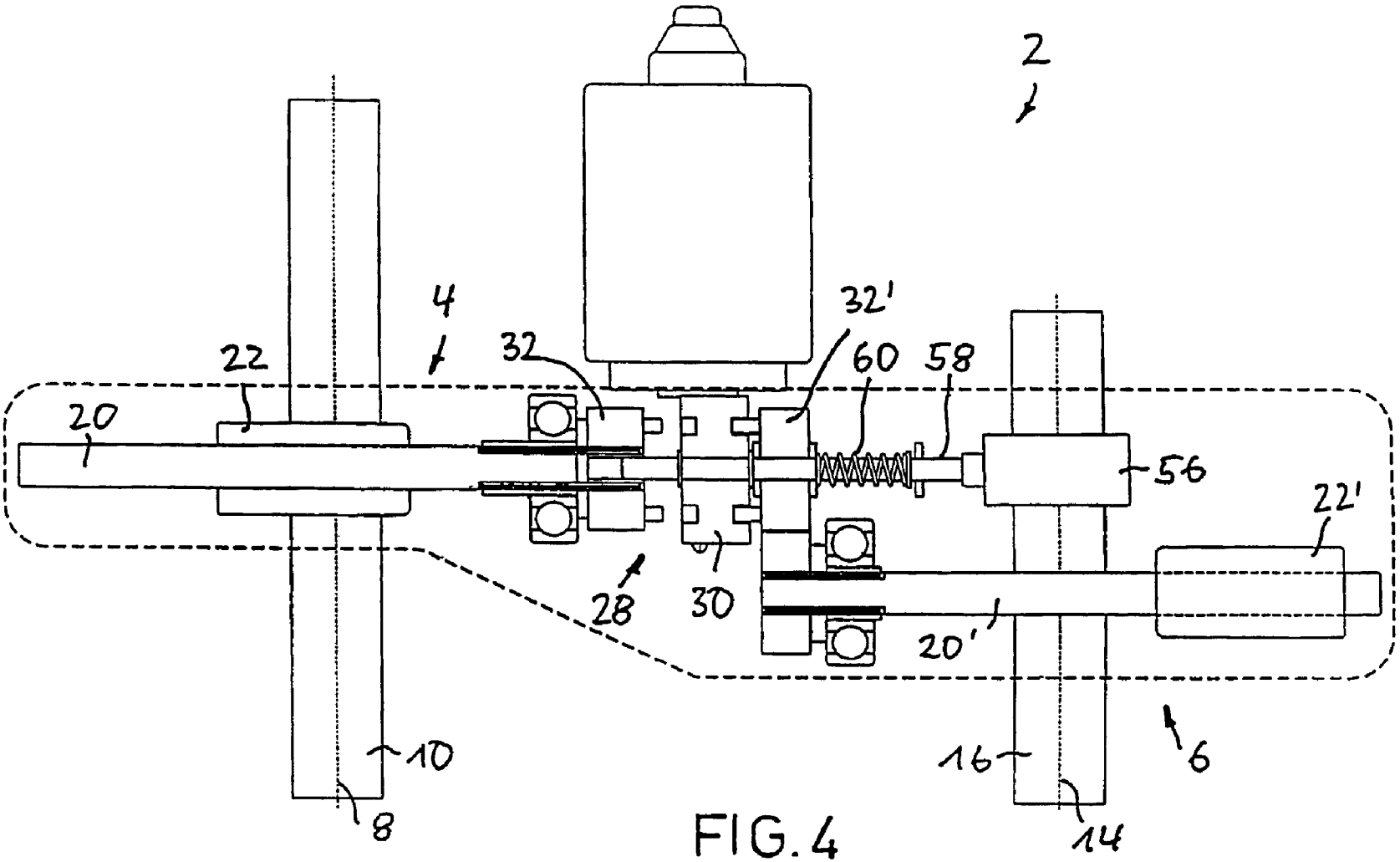

In order to de-couple the pinion end clutching element 30 from the take-off side clutching element 32 of the adjusting unit 4 and clutch-in with the take-off side clutching element 32' of the adjusting unit 6, the electromagnet is switched to be currentless, so that the pressure spring 60, which is arranged coaxially on the axle 58 moves this axle 58 towards the right in FIG. 3 until the second clutching position represented in FIG. 4 has been reached, in which position the pinion end clutching element 30 engages the take-off side clutching element 32' of the adjusting unit 6, while the take-off side clutching element 32 of the adjusting unit 4 is out of engagement of the pinion end clutching element 30.

Instead of the electromagnet, it is also possible to use a miniaturized servo motor by means of which the axle 58 can be displaced in the axial direction.

Apart from the clutching positions represented in FIGS. 3 and 4, the mounting axle 58 may, if necessary, also be controlled to achieve a further clutching position in which both take-off side clutching elements 32, 32' are out of engagement with the pinion end clutching element 30. In this clutching position, the slatted grid portions adjusted by means of the furniture actuator 2 may be reset manually unless the spindle drives 20, 22; 20', 22', respectively, are formed to be self-locking.

Figure 5:
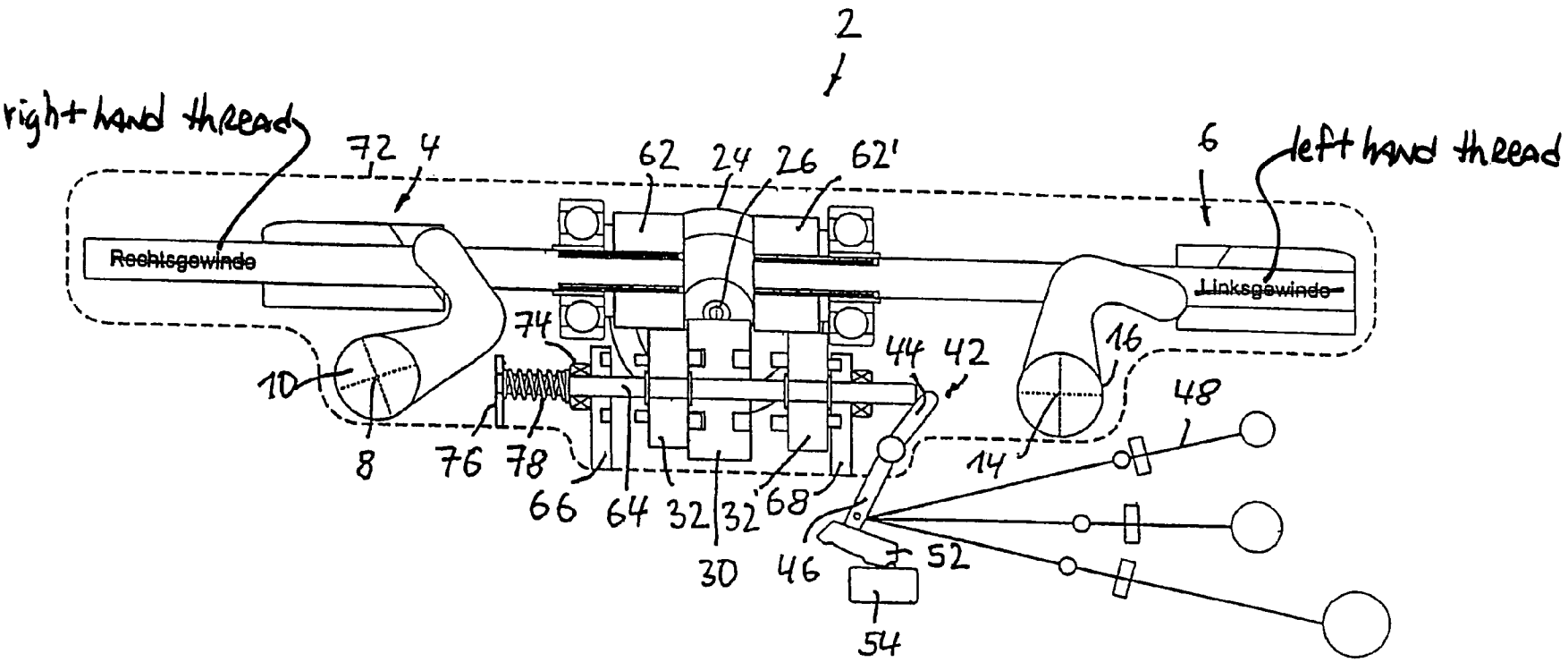

A third exemplified embodiment of a furniture actuator according to the invention is represented in FIG. 5 and differs from the exemplified embodiment according to FIG. 1, particularly in that the take-off side clutching elements 32, 32' are not connected to the spindles 20, 20' in a torque proof manner, but are in rotary drive connection with the spindles 20, 20', respectively, via a gearing arrangement. In the exemplified embodiment according to FIG. 5, the gearing arrangement is formed by a pair of spur(-toothed) wheels, of which one spur wheel 62; 62', respectively, is connected in a torque proof manner to the spindle 20, 20', respectively, whereas the other spur wheel is formed by the take-off side clutching element 32, 32', respectively, which for this purpose is provided with a toothing at its radial outer surface.

Furthermore, the exemplified embodiment according to FIG. 5 differs from the exemplified embodiment according to FIG. 1 in that the pinion side clutching element 30 is stationary, whereas the power-take offside clutching elements 32, 32' formed as spur wheels are axially moveable. To this end, the power take-off side clutching elements 32, 32' are mounted at a fixed axial distance relative to each other on an axially moveable axle 64, whereby the axial distance of the take-off side clutching elements 32, 32' is selected such that in a first position of axle 64 represented in FIG. 5 the take-off side clutching element 32 of the first adjusting unit 4 engages the pinion side clutching element 30 and the take-off side clutching element 32' of the second adjusting unit 6 is out of engagement of the pinion side clutching element 30, whereas in a second position of axle 64 represented in FIG. 6 the take-off side clutching element 32' of the second adjusting unit 6 engages the pinion side clutching element 30 and the take-off side clutching element 32 of the first adjusting unit 4 is out of engagement of the pinion side clutching element 30. The axle 64 is mounted moveably in an axial direction on the mounting webs 66, 68 which, for example, are held on the inner wall of a housing 72 of the furniture actuator 2.

Axial movement of axle 64 towards the left in FIG. 5 is brought about by means of the two-armed lever 42, which can be swivelled counterclockwise in FIG. 5 by means of the pull-string 48, whereby the free end of the lever arm 44 presses against an end of axle 64.

Figure 6:
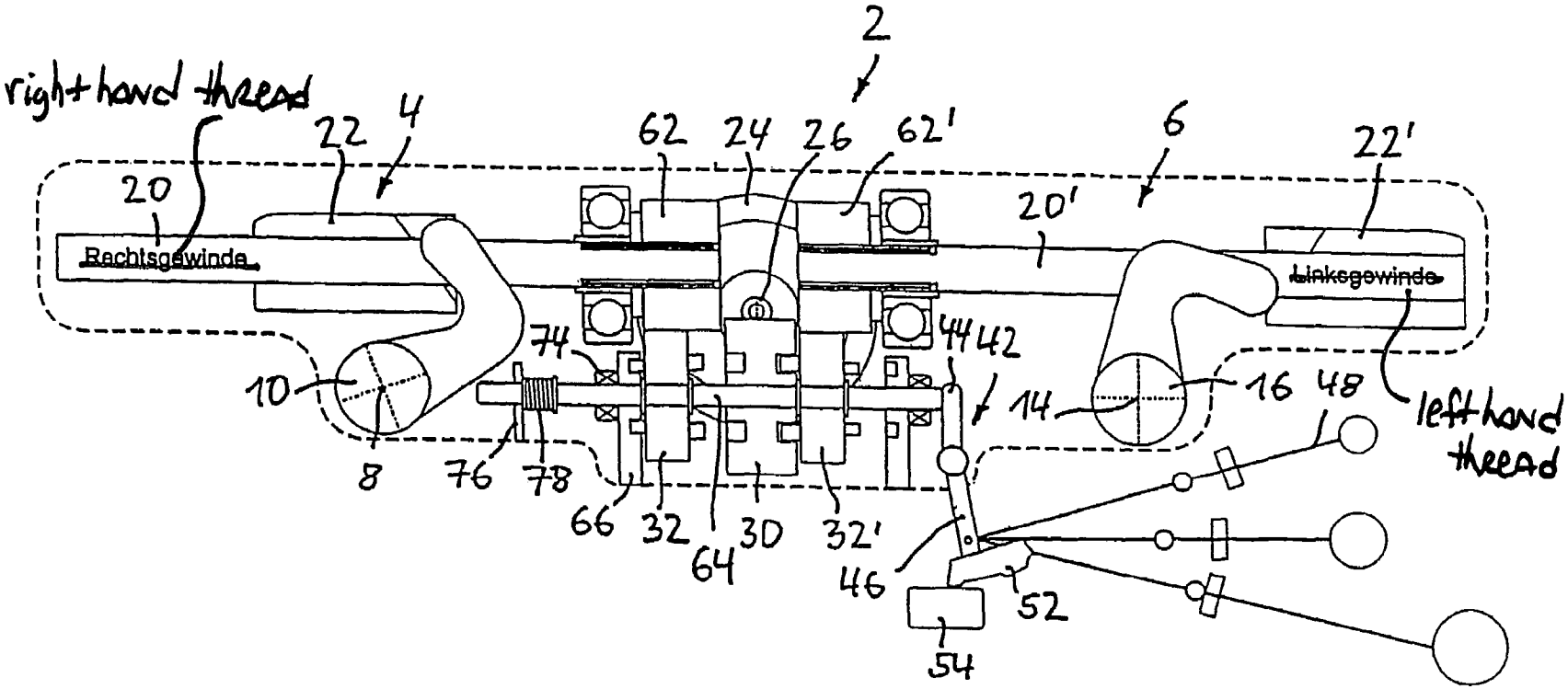

FIG. 5 shows the first clutching position of coupling clutch 28, in which position the take-off side clutching element 32 of adjusting unit 4 engages the pinion side clutching element 30. In contrast thereto, FIG. 6 represents the second clutching position in which the take-off side clutching element 32' of adjusting unit 6 engages the pinion side clutching element 30. For biasing the axle 64 into the first clutching position represented in FIG. 5, spring means are provided which in this exemplified embodiment have a pressure spring 78 arranged between a ball-bearing 74 connected to the mounting web 66, and a further web 76.

Figure 7:
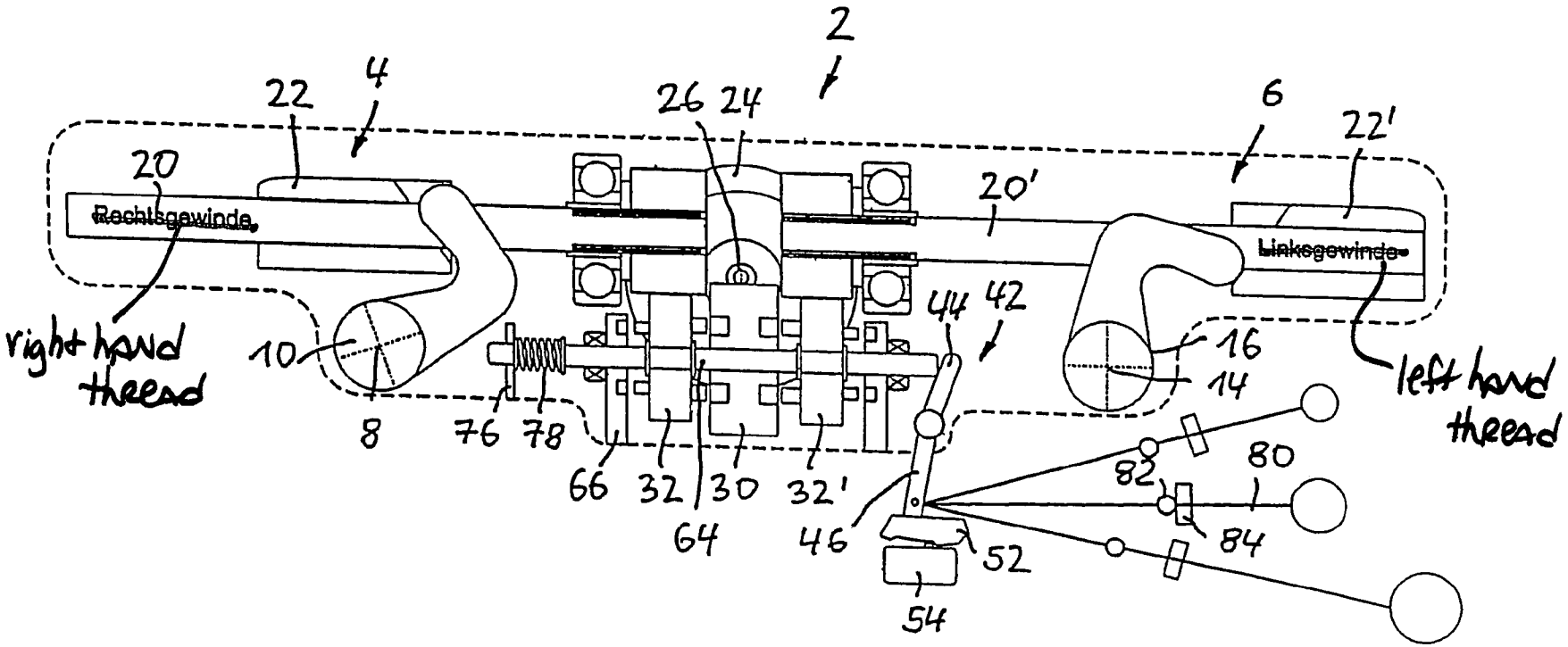

In FIG. 7 a further clutching position is represented in which the take-off side clutching element 32 of adjusting unit 4 as well as the take-off side clutching element 32' of adjusting unit 6 are both out of engagement of the pinion side clutching element 30. In order to be able to move the shaft 64 into the corresponding axial position, a further pull-sting 80 may be provided which has an enlargement 82 which moves against an abutment 84 arranged stationarily when the axle 64 is in an axial position in which both adjusting units 4, 6 are de-coupled with respect to the drive motor 24.

Figure 8:
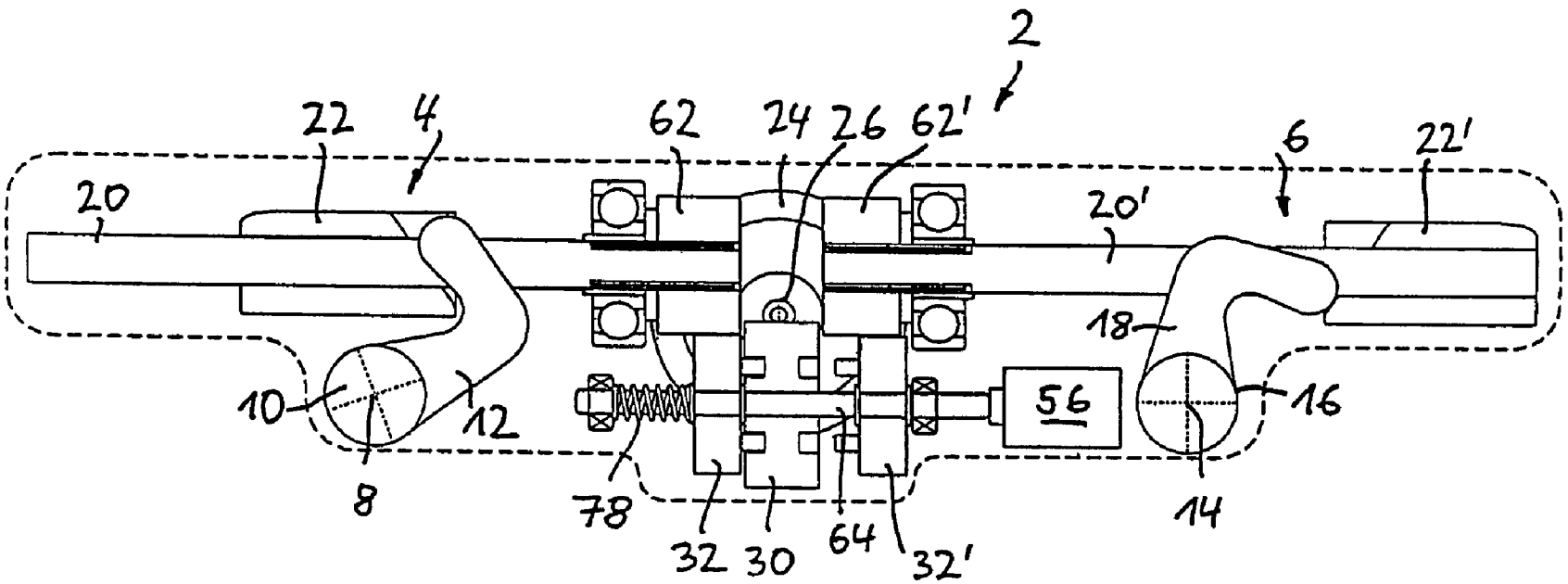
Figure 9:
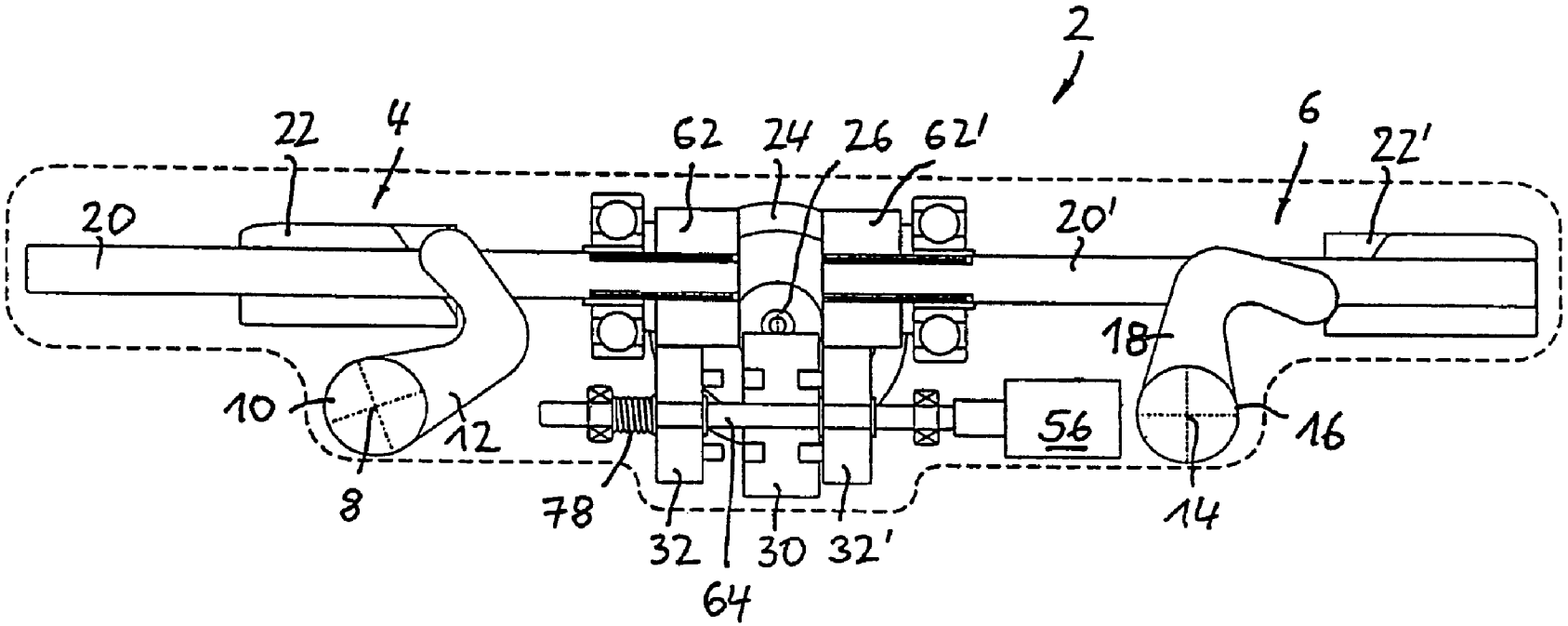

A fourth exemplified embodiment of a furniture actuator 2 according to the invention is represented in FIG. 8 differing from the exemplified embodiment according to FIG. 5 in that the axle 64 can be shifted from the first clutching position shown in FIG. 8 to the second clutching position shown in FIG. 9 by means of an electromagnet. By means of the pressure spring 78 a returning of the axle 64 from the second clutching position into the first clutching position is brought about.

Figure 10:
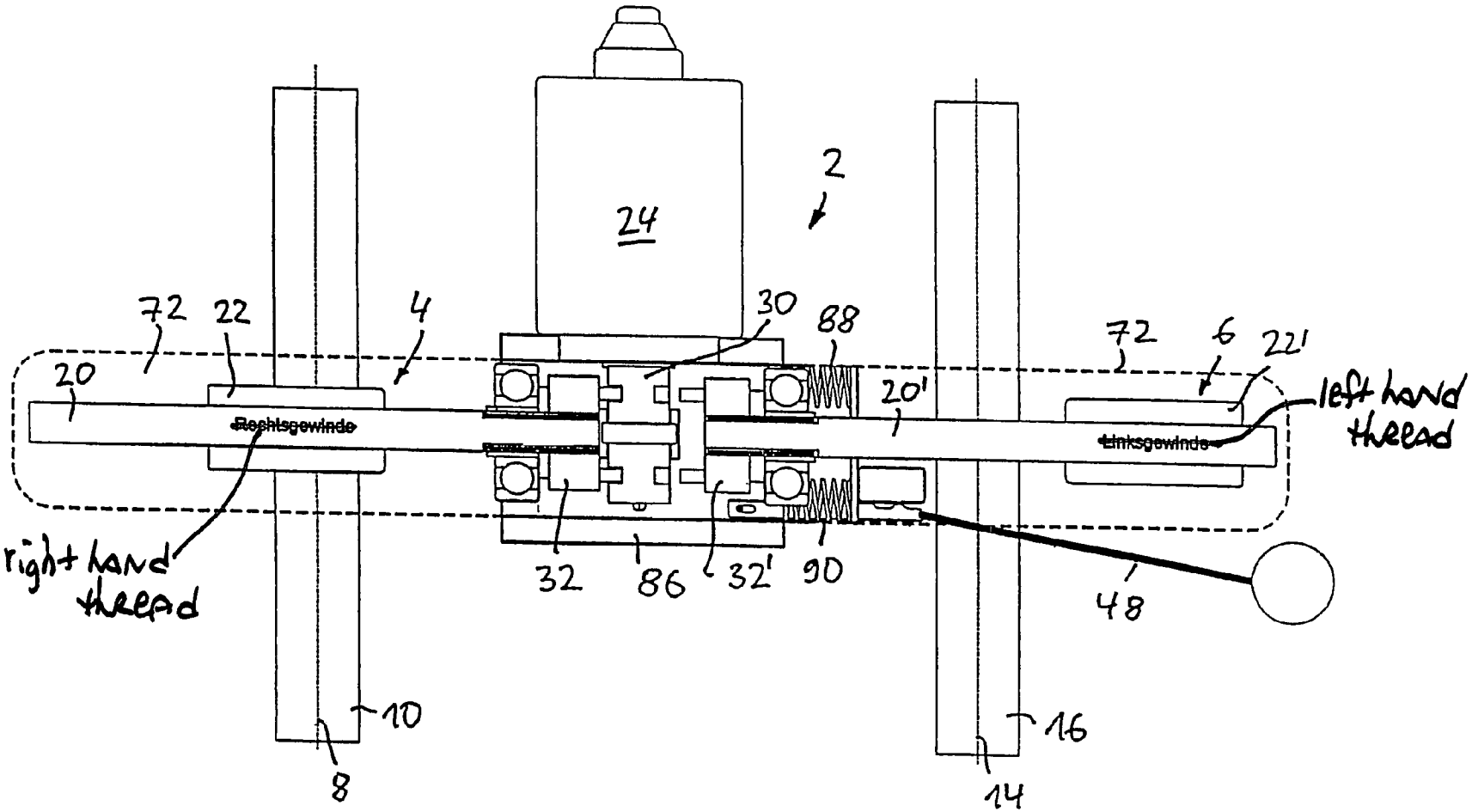
Figure 11:
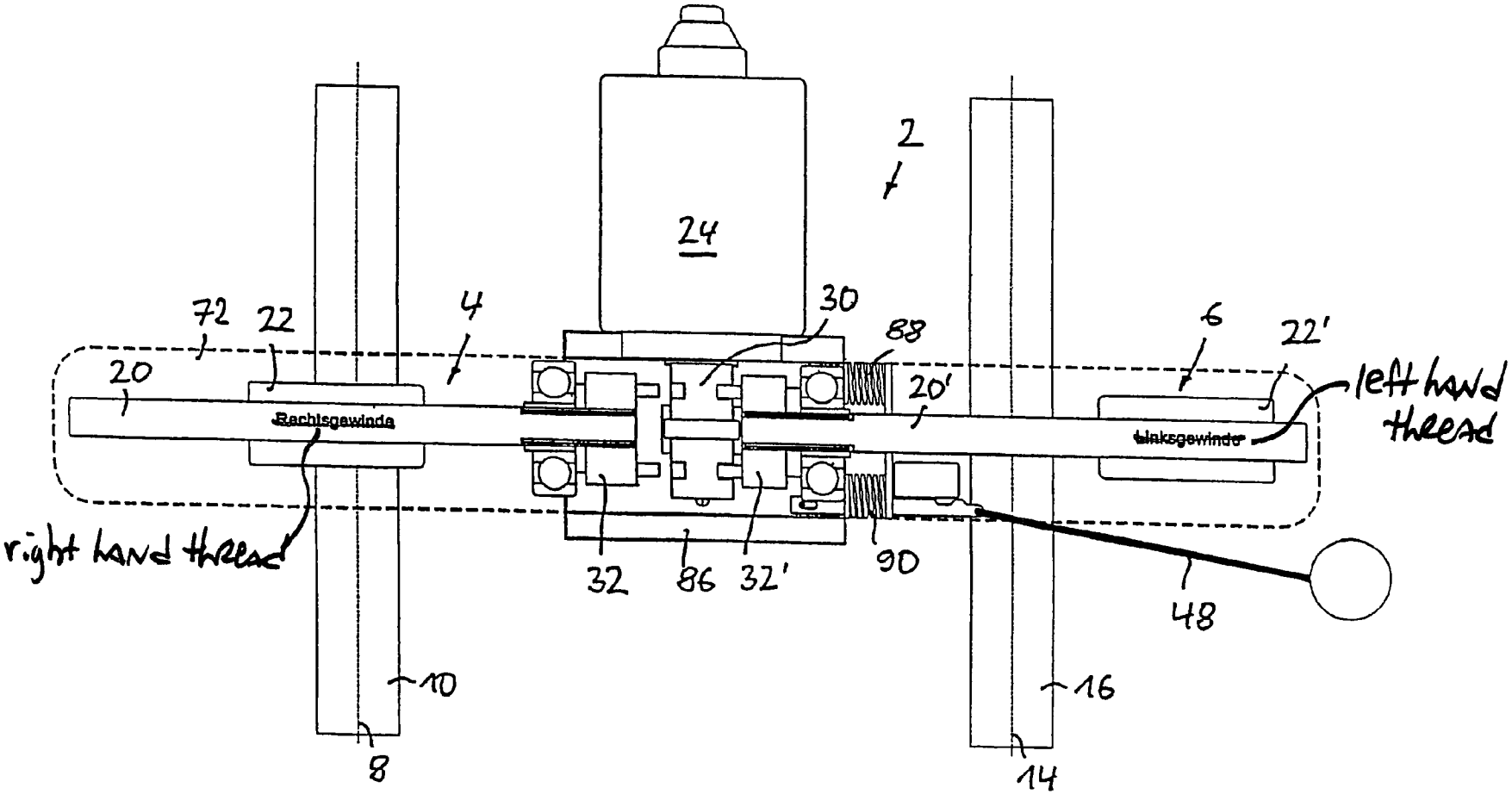

A fifth exemplified embodiment of a furniture actuator 2 according to the invention is represented in FIG. 10 and differs from the exemplified embodiment according to FIG. 1 in particular in that the drive motor 24 is not arranged stationarily, but, together with the pinion side clutching element 30, on a support or holding device 86 moveable in the axial direction of the pinion side clutching element 30. Axial shifting of the pinion side clutching element 30 together with the drive motor 24 from the first clutching position represented in FIG. 10 into the second clutching position represented in FIG. 11 is brought about by pulling the pull-string 48 towards the right in FIG. 10, whereas a return into the first clutching position occurs under the effect of two pressure springs 88, 90 which are arranged between the support means 86 and a stationary portion of the housing 72 of the furniture actuator.

Figure 12:
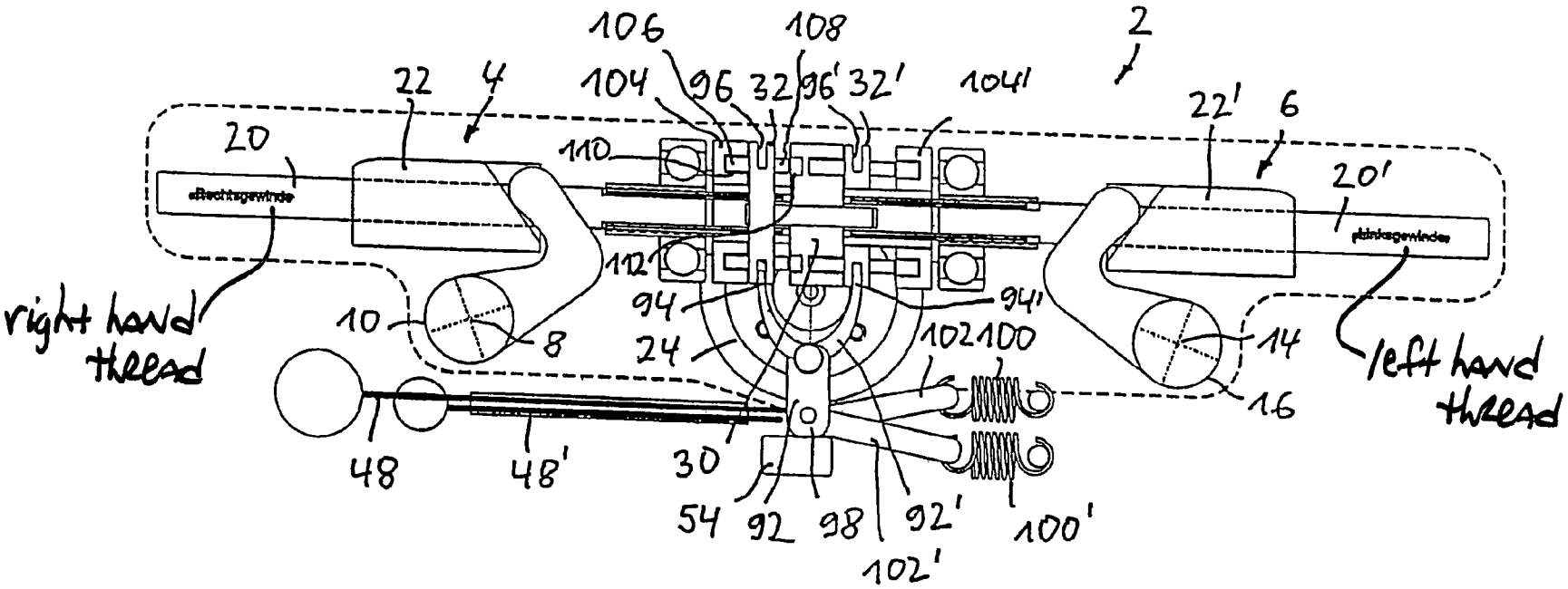

A sixth exemplified embodiment of a furniture actuator 2 according to the invention is represented in FIG. 12 and differs from the exemplified embodiment according to FIG. 5 particularly in that the take-off side clutching elements 32, 32' can be moved axially separate from each other. For an axial shifting of the take-off side clutching element 32 of the adjusting unit 4 a two-armed lever 92 has been provided whose one lever arm 94 engages a circumferential groove 96 on the outer circumference of the power take-off side clutching element 32, whereas its other lever arm is connected to the pull-string 48. In order to bias the two-armed lever 92 into the position represented in FIG. 12 a tension string 100 is provided which is connected to the second lever arm 98 of the two-armed lever 92 via a lever 102.

In a manner corresponding to this structure, a further two-armed lever 92', whose one lever arm 94' engages a circumferential groove 96' formed on the radial outer surface of the take-off side clutching element 32, and whose other lever arm is connected to a further pull-string 48' is associated with the take-off side clutching element 32' of adjusting unit 6.

A further clutching element 104, 104', respectively, is associated to the adjusting units 4, 6, which clutching element is arranged, when seen in the axial direction, on the side of the take-off side clutching element 32, 32', respectively, opposite the pinion side clutching element 30. The respective further clutching element 104, 104', respectively, is, in this example of embodiment, connected in a torque proof manner with the associated spindle 20, 20', respectively.

The pinion end clutching element 32 has on both its axial sides axial protrusions 106, 108 which are provided for engaging recesses 110, 112, respectively, of the further clutching element or the pinion side clutching element 30, respectively, which recesses have a complementary shape with respect to the protrusions 106, 108. The power take-offside clutching element 32' of the adjusting unit 6 is formed in a corresponding manner thereto, whereby, for the sake of clarity, the associated reference numerals have been omitted in FIG. 12.

Figure 13:
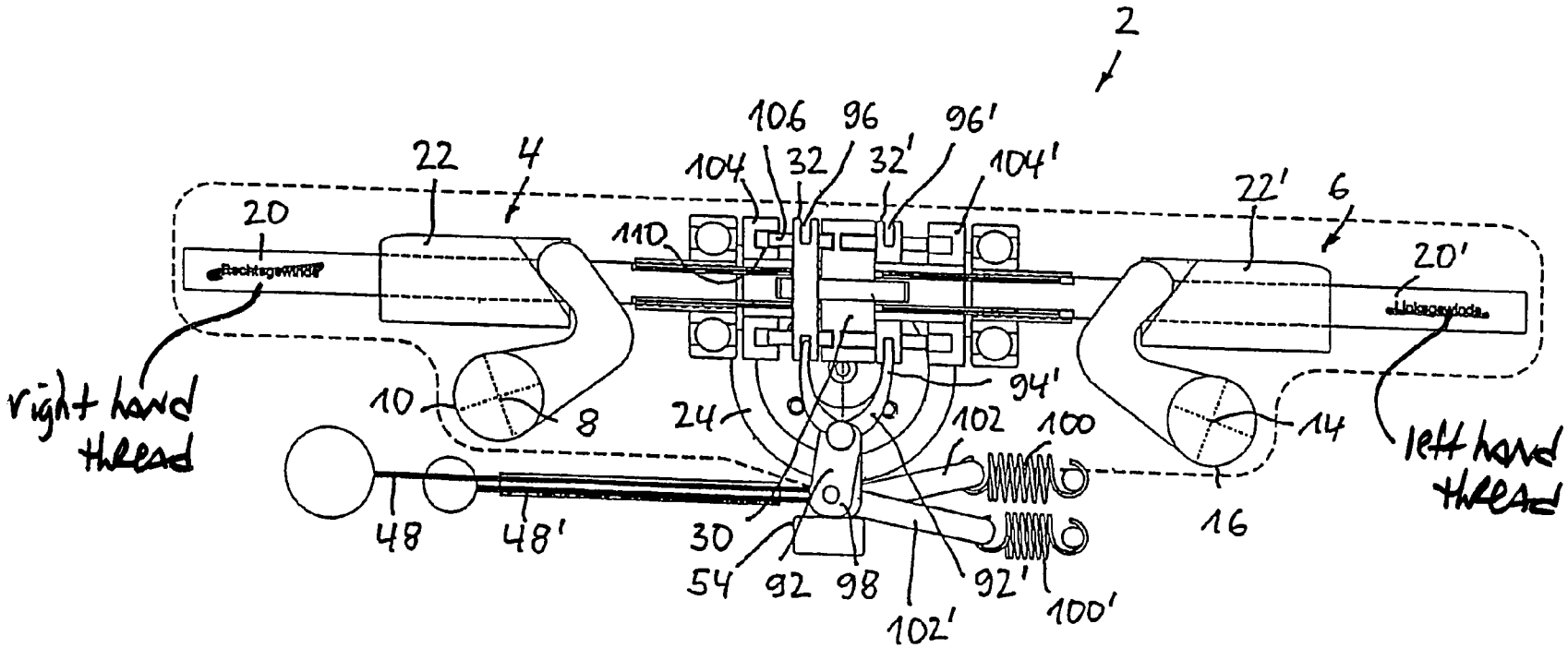

In order to be able to make the power take-off side clutching element 32 of the adjusting unit 4 engage the pinion end clutching element 30, the pull-string 48 is pulled towards the left in FIG. 12, so that the lever 92 pivots clockwise and hereby moves the take-off side clutching element 32 in the axial direction towards the right in FIG. 12 and brings it into engagement with the pinion end clutching element 30 as has been shown in FIG. 13. As can be taken from FIG. 13, the axial lengths of the protrusions 106, 108 are dimensioned such that in an axial position in which the take-off side clutching element 32 is already engaging the pinion end clutching element 30, the power take-off side clutching element 32 is still engaging the other clutching element 104, so that in this axial position represented in FIG. 13 the further clutching element 104 is connected in a torque proof manner with the pinion end clutching element 30. A resetting of the power take-off side clutching element 32 into the position represented in FIG. 12 occurs by the biasing force of tension spring 100.

Figure 14:
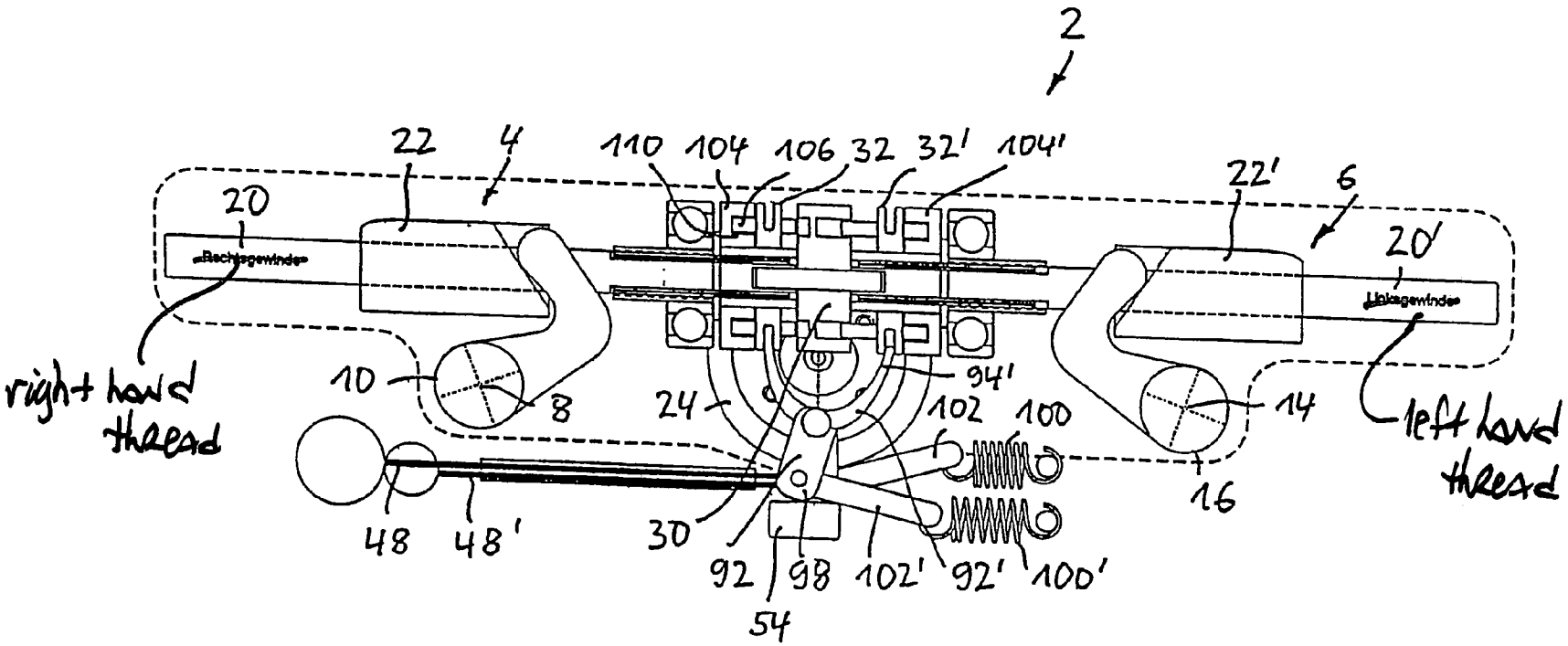

In a manner corresponding herewith, an axial displacement of the power take-off side clutching element 32' of the adjusting unit 6 occurs by pulling the pull-string 48 towards the left in FIG. 12 until the power take-off side clutching element 32' engages the further clutching element 104' of the adjusting unit 6 and thus clutches in the adjusting unit 6 to the drive motor 24 as becomes apparent from FIG. 14. As becomes apparent from FIG. 14, the axial lengths of the axial protrusions on the power take-off side clutching element 32' are dimensioned such that the power take-off side clutching element 32 is still in engagement with the pinion side clutching element 30 when the take-off side clutching element 32' already engages the further clutching element 104'. In this axial position of the take-off side clutching element 32' the further clutching element 104' is connected with the take-off side clutching element 30 in a torque proof manner.

Figure 15:
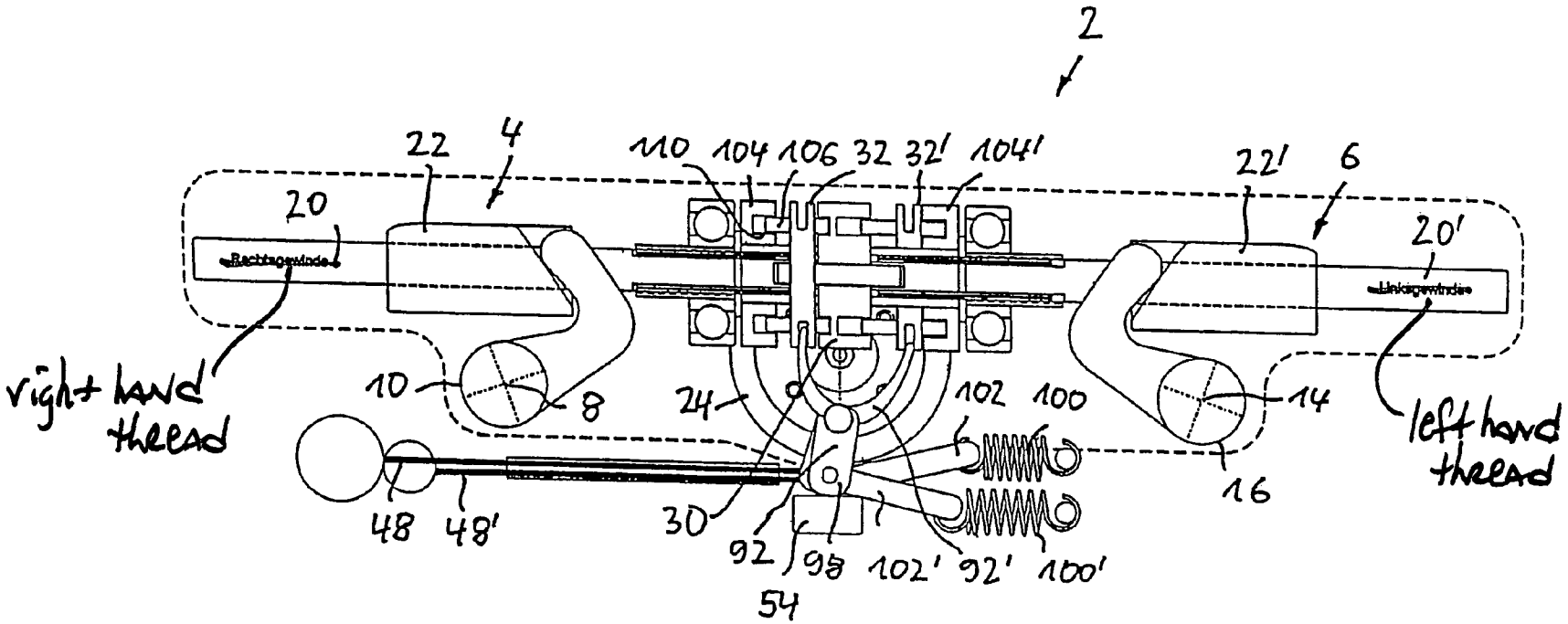

In FIG. 15 a further clutching position has been represented, in which the take-off side clutching element 32 engages the further clutching element 104 and the side clutching element 30, while the take-off side clutching element 32' engages the pinion side clutching element 30 and the further clutching element 104', so that both adjusting units are clutched-in with the drive motor 24.

Figure 16:
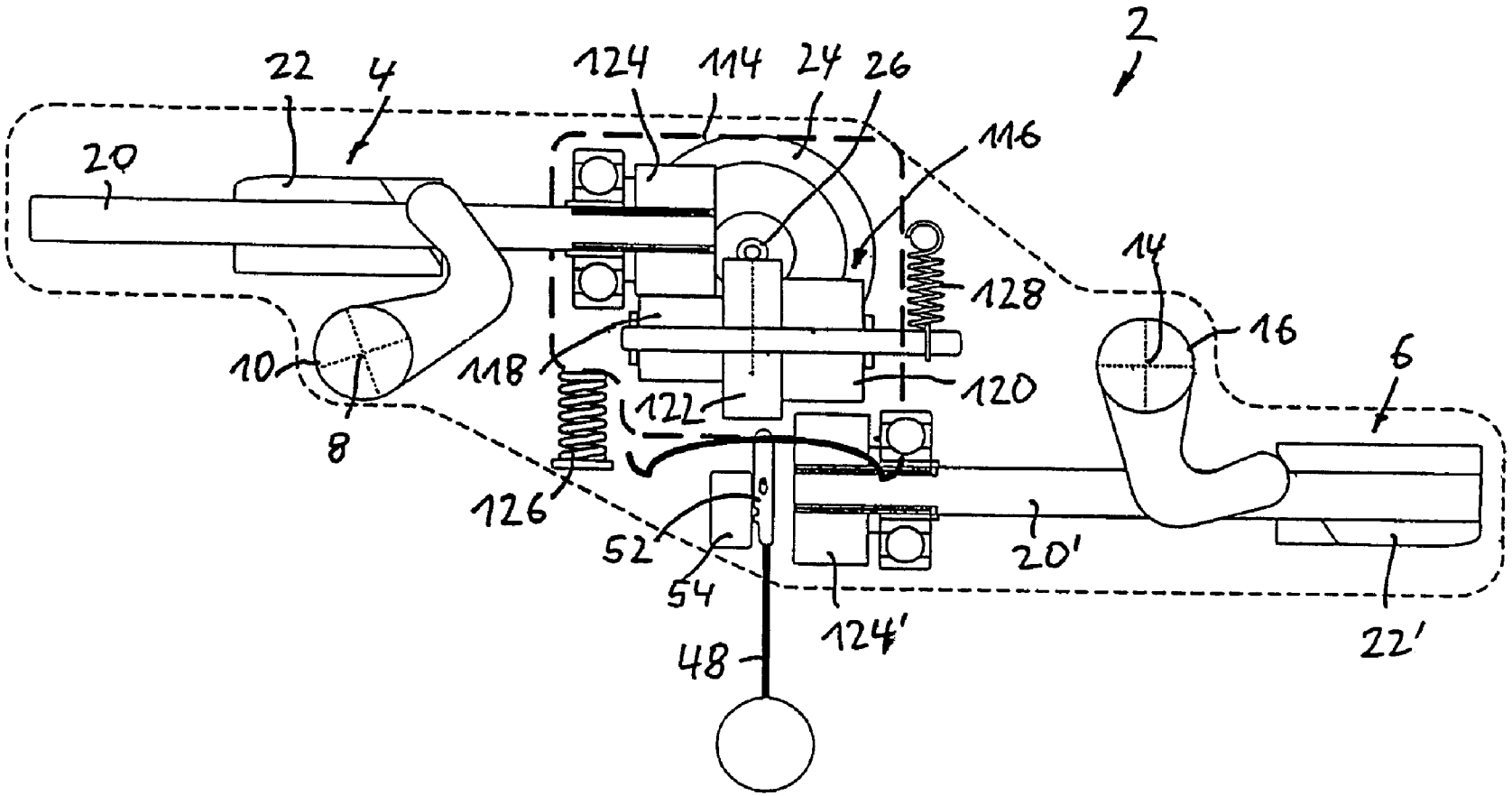

In FIG. 16 a further exemplified embodiment of a furniture actuator 2 according to the invention is represented which differs from the preceding examples of embodiment in that the coupling means are not formed as a clutching arrangement, but rather have a moveable support or holding device 114 on which a gearing arrangement 116 is mounted. The gearing arrangement 116 is, in this exemplified embodiment, formed by a pair of spur(-toothed) wheels 118, 120 which are connected torque proofly to a worm wheel 122 which engages the worm 26 of the drive motor 24. The drive motor 24 is also mounted on the moveable support 114 so that the worm wheel 122 always remains in engagement with the worm 26 when the support 114 is displaced. Spur wheels 124, 124', respectively, are connected in a torque proof manner with the spindles 20, 20' which are arranged parallel to each other, whereas the spur wheels 122, 122' are arranged at an axial distance to each other. In the position of support 114 represented in FIG. 16 the spur wheel 118 of the gearing arrangement 116 engages the spur wheel 122 of the first adjusting unit 4 so that the spindle 20 is in a rotary drive connection with the drive motor 24.

Figure 17:
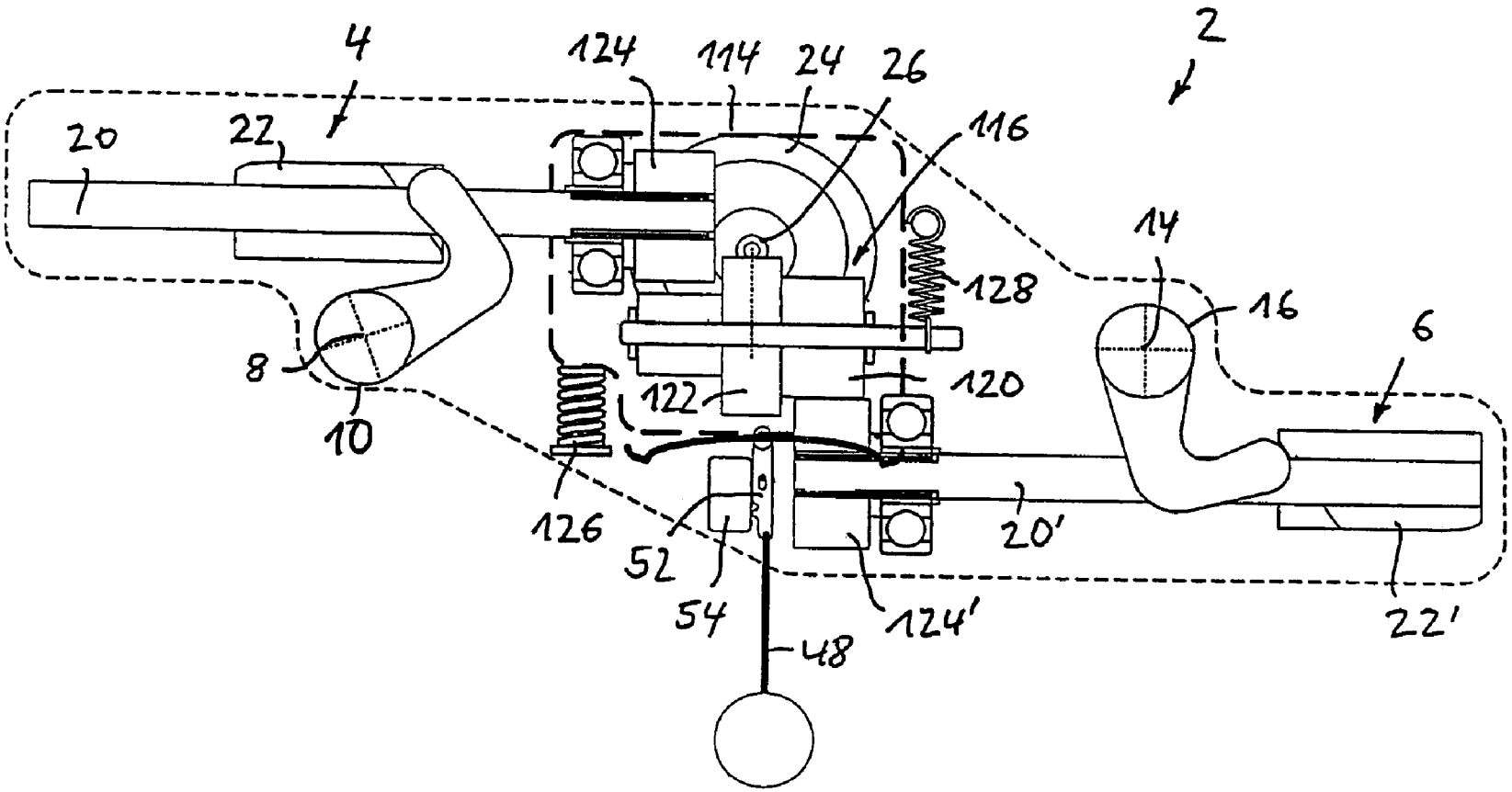

In order to be able to move the support 114 from the first position shown in FIG. 16 into a second position shown in FIG. 17, the support 114, which in this exemplified embodiment is mounted to be linearly displaceable, is pulled downwards when taking FIG. 16, by means of the pull-string 48, whereby the spur wheel 118 disengages from spur wheel 124, whereas spur wheel 120 comes into engagement with spur wheel 124', so that at this time the adjusting unit 6 is in rotary drive engagement with the drive motor 24.

A return from the second position represented in FIG. 17 into the first position represented in FIG. 16 is brought about by the bias of springs 126, 128.

Figure 18:
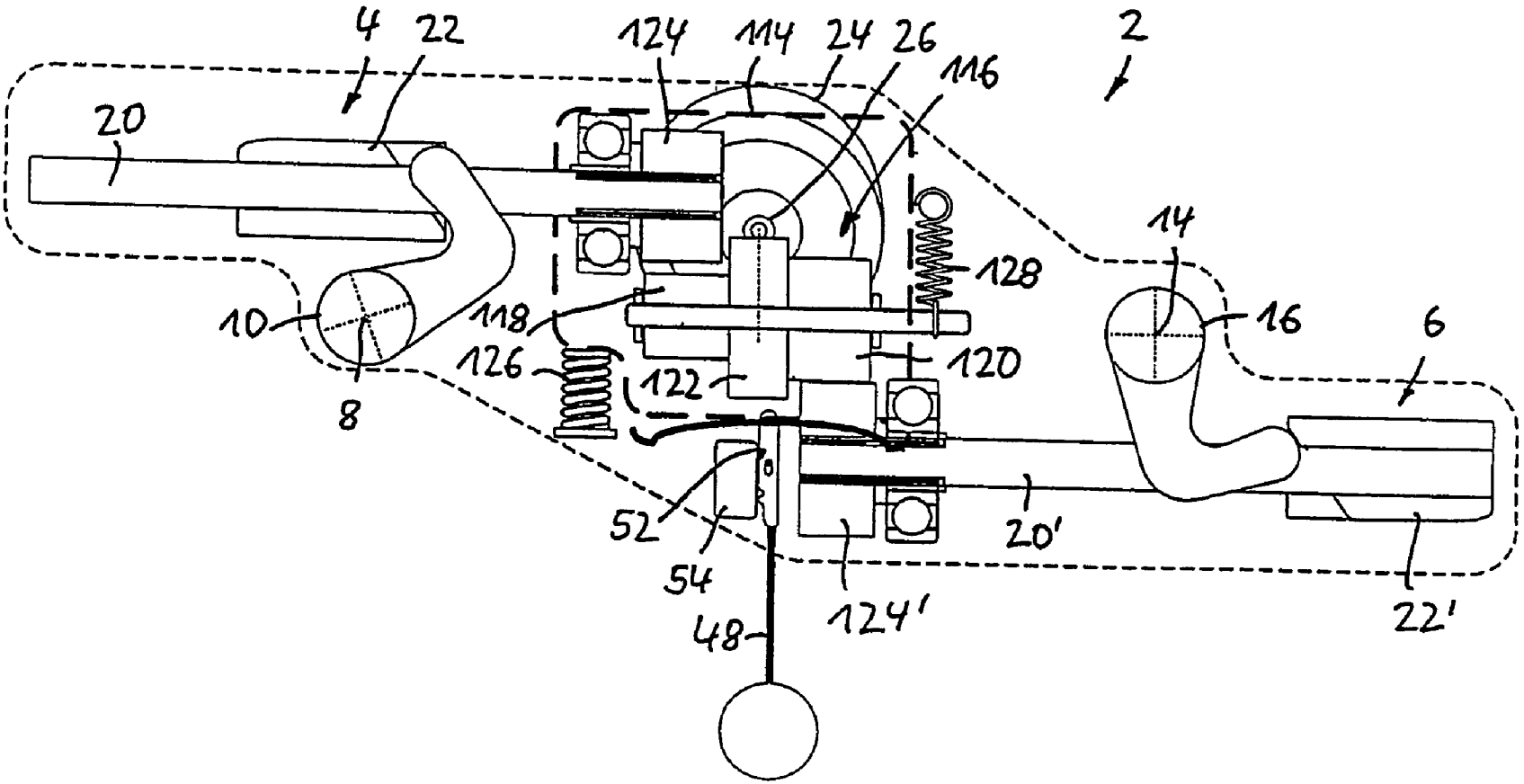

A modification of the exemplified embodiment according to FIG. 16 provides for the support 114 as well as being tiltable, as has been indicated in FIG. 18.

Figure 19:
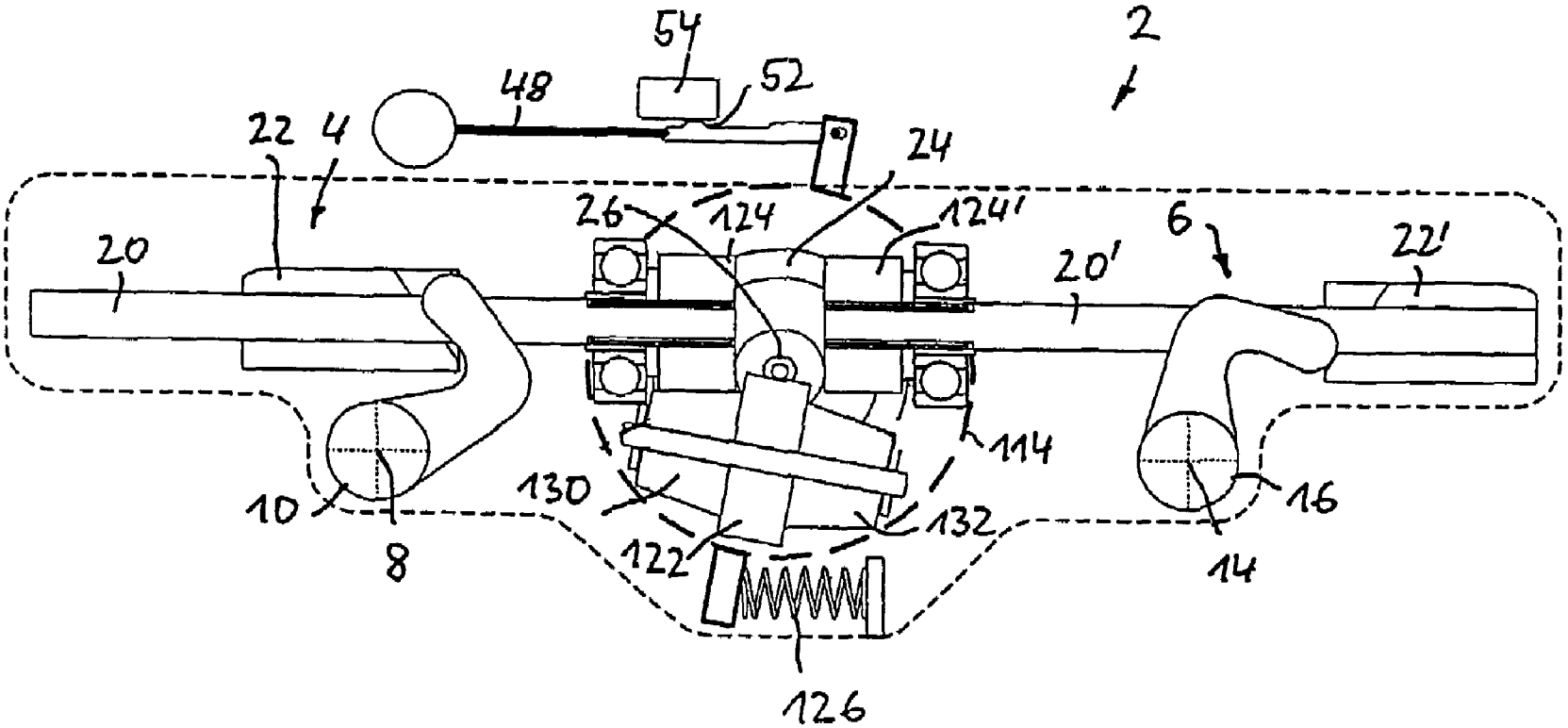
Figure 20:
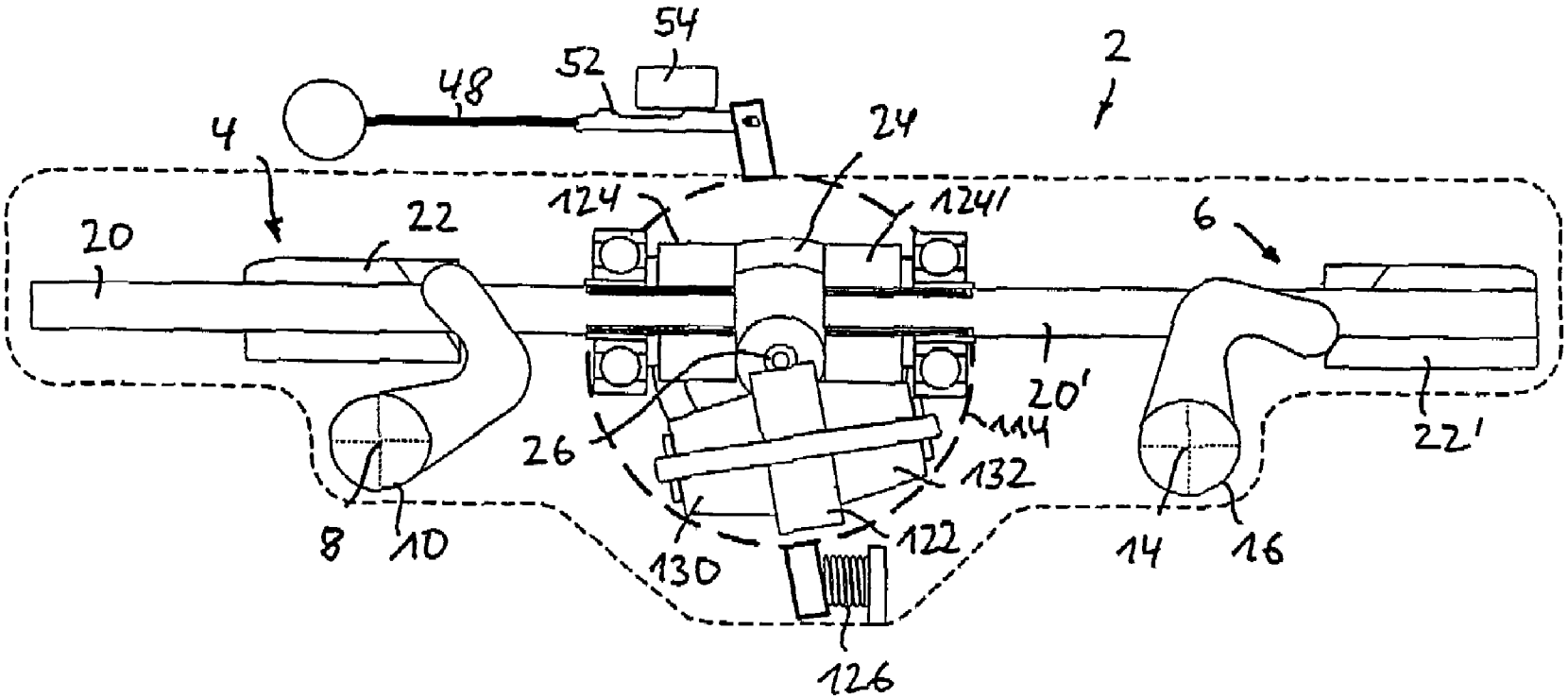

An eighth exemplified embodiment of the furniture actuator 2 according to the invention is represented in FIG. 19, the difference regarding the exemplified embodiment according to FIG. 16 being that the support 114 is mounted to rotate in a radius around the take-off shaft of the drive motor 24, and that instead of spur wheels, bevel wheels 130, 132 have been provided. In the position shown in FIG. 19, the drive motor 24 is in rotary drive connection with the adjusting unit 4, whereas in the position shown in FIG. 20 it is in rotary drive connection with the second adjusting unit 6.

What is claimed is:

1. Electromotive furniture actuator for adjusting portions of a piece of furniture relative to each other, having two electromotively driven adjusting units, each of which is, in the assembled position of the furniture actuator, functionally connected to a portion of the piece of furniture to be adjusted for adjusting the same, characterized by a mutual drive motor (24) for driving the adjusting units (4; 6) and coupling means which are moveable between a first position and a second position and couple the drive motor (24), in the first position, to the first adjusting unit (4) and, in the second position, to the second adjusting unit (6), and thus to bring them into driving connection with the respective adjusting unit (4; 6).

2. Furniture actuator according to claim 1, characterized in that the adjusting units (4; 6) each have an actuating element to be driven to rotate, the drive motor (24), in a first position of the coupling means, being in rotary driving connection with the actuating element of the first adjusting unit (4) and, in a second position of the coupling means, with the actuating element of the second adjusting unit (6).

3. Furniture actuator according to claim 2, characterized in that the actuating element to be driven to rotate is part of a spindle drive (20, 22; 20', 22') which has a linearly moveable adjusting element being functionally connected, in the assembled position of the furniture actuator (2), with a portion of the piece of furniture to be adjusted.

4. Furniture actuator according to claim 3, characterized in that the actuating element is a stationary spindle (20; 20') mounted to be driven to rotate, on which a spindle nut (22;22') is arranged in a torque proof manner and moveable in the axial direction, which forms the adjusting element or is connected to the adjusting element.

5. Furniture actuator according to claim 3, characterized in that the actuating element is a stationary spindle nut mounted to be rotated and arranged on a spindle which is move able in the axial direction, torque proof and forms the adjusting element or is connected to the adjusting element.

6. Furniture actuator according to claim 3, characterized in that the linearly moveable element is in functional connection with a pivotably mounted shaft (10; 16) for pivoting the same in the assembled position of the furniture actuator, wherein the shaft (10; 16) is in functional connection with a portion of the piece of furniture to be adjusted.

7. Furniture actuator according to claim 6, characterized in that a pivot lever (12; 18) is connected to the shaft (10; 16) in a torque proof manner, which lever is pivotable by means of the linearly moveable adjusting element.

8. Furniture actuator according to claim 2, characterized in that the coupling means have a clutching arrangement which, in a first clutching-in position clutches-in the actuating element of the first adjusting unit (4), and, in a second clutching-in position, clutches-in the actuating element of the second adjusting unit (6) to the drive motor (24), and thus brings the drive motor (24) into a rotary drive connection with the respective actuating element.

9. Furniture actuator according to claim 8, characterized in that the clutching arrangement has a third clutching-in position in which the actuating element of the first adjusting unit (4) as well as the actuating element of the second adjusting unit (6) are clutched-in to the drive motor (24).

10. Furniture actuator according to claim 8, characterized in that the clutching arrangement has a fourth clutching position in which the actuating element of the first adjusting unit (4) as well as the actuating element of the second adjusting unit (6) are de-coupled from the drive motor (24).

11. Furniture actuator according to claim 8, characterized in that the clutching arrangement has at least one clutch coupling or shifting coupling clutch (28).

12. Furniture actuator according to claim 11, characterized in that the coupling clutch (28) is a shifting clutch with positive engagement.

13. Furniture actuator according to claim 1, characterized in that the coupling clutch (28) has a clutching element (30) on the pinion end side which is in rotary driving connection with the drive motor (24), and that the rotatingly driveable actuating elements of the adjusting units (4; 6) are each associated with a power take-off side clutching element (32; 32'), wherein the power take-off side clutching elements (32; 32') can be brought into engagement with the pinion end clutching element (30) in order to clutch in the respective adjusting unit (4; 6) to the drive motor (24).

14. Furniture actuator according to claim 13, characterized in that the power take-off side clutching element (32; 32') associated with an adjusting unit (4; 6) is connected with the actuating element of this adjusting unit (4; 6) in a torque proof manner.

15. Furniture actuator according to claim 13, characterized in that the power take-off side clutching element (32; 32') associated with an adjusting unit (4; 6) is in rotary drive connection with the actuating element of this adjusting unit (4; 6) via a gearing arrangement.

16. Furniture actuator according to claim 15, characterized in that the power take-off side clutching element (32; 32') is designed as a toothed wheel or is connected to a toothed wheel in a torque proof manner, which toothed wheel engages a toothed wheel (62; 62') connected to the actuating element in a torque proof manner.

17. Furniture actuator according to claim 16, characterized in that the toothed gears (62; 62') are spur-toothed wheels.

18. Furniture actuator according to claim 13, characterized in that the pinion side clutching element (30) is designed as a worm wheel or connected to a worm wheel in a torque proof manner, which worm wheel is in engagement with a worm (26) connected to the power take-off shaft of the drive motor.

19. Furniture actuator according to claim 13, characterized in that the pinion side clutching element (30) and/or at least one of the power take-off side clutching elements (32;32') is mounted in an axially moveable manner such that by axial movement of the pinion side clutching element (30) and/or at least one of the power take-off side clutching elements (32; 32') the power take-off side clutching elements (32; 32') can be brought out of and in engagement, respectively, with the pinion side clutching element.

20. Furniture actuator according to claim 19, characterized in that the power take-off side clutching elements (32; 32') are arranged in a stationary manner and that the pinion side clutching element (30) is arranged in the axial direction between the power take-off side clutching elements (32; 32') and axially moveable.

21. Furniture actuator according to claim 19, characterized in that the pinion side clutching element (30) is arranged in a stationary manner and that at least one of the power take-off side clutching elements (32; 32') is axially moveable.

22. Furniture actuator according to claim 21, characterized in that the power take-off side clutching elements (32; 32') are axially moveable separate from each other.

23. Furniture actuator according to claim 21, characterized in that the power take-off side clutching elements (32; 32') are axially moveable together.

24. Furniture actuator according to claim 23, characterized in that the power take-off side clutching elements (32; 32') are mounted at a fixed distance to each other on an axially moveable axle (64), wherein the axial distance of the clutching elements (32; 32') with regard to each other is selected such that in a first position of the axle (64) the power take-off side clutching element (32) of the first adjusting unit (4) is in engagement with the pinion side clutching element (30) and the power take-off side clutching element (32') of the second adjusting unit (6) is out of engagement of the pinion side clutching element (30), whereas in a second position of the axle (64) the power take-off side clutching element (32') of the second adjusting unit (6) is in engagement with the pinion side clutching element (30) and the power take-off side clutching element (32) of the first adjusting unit is out of engagement of the pinion side clutching element (30).

25. Furniture actuator according to claim 21, characterized in that one further clutching element (104; 104'), associated with at least one adjusting unit (4; 6), preferably at least one further clutching element associated with both adjusting units, is provided, which further clutching element is arranged, when seen in the axial direction, on the side opposite the pinion side clutching element (30) of the power take-off side clutching element (32; 32') of this adjusting unit (4; 6) and is in rotary drive connection with the actuating element of this adjusting unit (4; 6) such that by axial movement of the clutching element (32; 32') the further clutching element (104; 104'), and thus the actuating element, can be clutched-in with the pinion side clutching element (30) or be de-coupled therefrom.

26. Furniture actuator according to claim 25, characterized in that the power take-off side clutching elements (32; 32') of the adjusting units (4; 6) have axial protrusions (106,108) on both their axial sides, each, via which protrusions they engage complementarily-shaped recesses (110, 112) in the respective clutching position, which recesses are formed at the pinion side clutching element's (30) side facing the respective power take off side clutching element (32; 32'), and that of the further clutching element (104; 104').

27. Furniture actuator according to claim 25, characterized in that the pinion side clutching element (30) and the power take□off side clutching elements (32; 32') and, if necessary, the further clutching element (104; 104') are mounted in a co-axial manner.

28. Furniture actuator according to claim 21, characterized in that the drive motor (24) is arranged to be stationary.

29. Furniture actuator according to claim 21, characterized in that the pinion side clutching element (30) is arranged on moveable support means (86) together with the drive motor (24) such that the pinion side clutching element (30) can be moved together with the drive motor (24).

30. Furniture actuator according to claim 29, characterized in that the support means (86) can be displaced in the axial direction of the pinion side clutching element (30).

31. Furniture actuator according to claim 19, characterized by spring means for biasing the moveable clutching element (30; 32; 32') or at least one of the moveable clutching elements (30; 32; 32') into a start position.

32. Furniture actuator according to claim 19, characterized by activating means for moving the moveably mounted clutching elements (30; 32; 32').

33. Furniture actuator according to claim 2, characterized in that the drive motor (24) is capable of being brought into rotary drive connection with the actuating elements of the adjusting units (4; 6) via a gearing arrangement (116).

34. Furniture actuator according to claim 33, characterized in that the coupling means have a moveable support means (114) in which at least one gear element (118, 120,122) of the gearing arrangement (116) is mounted, wherein the support means (14) is moveable between a first position, in which the gearing arrangement (116) brings about the rotary drive connection of the actuating element of the first adjusting unit (4) with the drive motor (24), and a second position, in which the gearing arrangement (116) brings about the rotary drive connection of the actuating element of the second adjusting unit (6) with the drive motor (24).

35. Furniture actuator according to claim 34, characterized in that the support means (114) is linearly displaceable.

36. Furniture actuator according to claim 34, characterized in that the support means (114) is rotatable or tiltable.

37. Furniture actuator according to claim 35, characterized in that the gearing arrangement (116) has a first and a second toothed wheel (118, 120) which are mounted in a torque proof manner on a mutual shaft driven to rotate by the drive motor (24), and that a third gear wheel (124) and a fourth gear wheel (124') are associated with the actuating element of the first adjusting unit (4) and the actuating element of the second adjusting unit (6), respectively, wherein the support means (114) is moveable relative to the third and fourth gear wheels (124; 124') such that in the first position of the support means (114) the first gear wheel (118) engages the third gear wheel (124), whereas the second gear wheel (120) is out of engagement of the fourth gear wheel (124'), and that in the second position of the supporting means (114) the second gear wheel (120) engages the fourth gear wheel (124'), while the first gear wheel (118) is out of engagement of the third gear wheel (124).

38. Furniture actuator according to claim 37, characterized in that the first and the second gear wheels are bevel wheels (130, 132).

39. Furniture actuator according to claim 38, characterized in that the support means (114) is rotatable in the radius about the take-off shaft of the drive motor (24).

40. Furniture actuator according to claim 37, characterized in that the drive motor (24) is arranged on the support means (114) in a manner that the gearing arrangement (116) is moveable together with the drive motor (24).

41. Furniture actuator according to claim 34, characterized by spring means for biasing the support means (114) into a starting position.

42. Furniture actuator according to claim 34, characterized by actuating means for moving the support means.

43. Furniture actuator according to claim 42, characterized in that the actuating means are mechanical actuating means.

44. Furniture actuator according to claim 43, characterized in that the mechanical actuating means have pulling means which can be operated manually.

45. Furniture actuator according to claim 42, characterized in that the actuating means are electromechanical actuating means.

46. Furniture actuator according to claim 44, characterized in that the electromechanical actuating means have at least one electromagnet (56).

47. Furniture actuator according to claim 44, characterized in that the electromechanical actuating means have at least one servo motor.

48. Furniture actuator according to claim 42, characterized by at least one two-armed lever (42) whose one lever arm (44) is functionally connected to the moveable component and whose other lever arm (46) is functionally connected to the actuating means.

49. Furniture actuator according to claim 1, characterized by switching means for switching the drive motor on and off.

50. Furniture actuator according to claim 3, characterized in that the spindle drive is self locking.

51. Furniture actuator according to claim 3, characterized in that the spindle drive (20, 22; 15 20', 22') is non-self-locking.

52. Furniture actuator according to claim 1, characterized by controlling means for controlling the direction of rotation of the drive motor.

* * * * *